US009915887B2

(12) United States Patent
Ota et al.

(10) Patent No.: US 9,915,887 B2
(45) Date of Patent: Mar. 13, 2018

(54) TONER FOR DEVELOPMENT OF ELECTROSTATIC IMAGES

(71) Applicant: MITSUBISHI CHEMICAL CORPORATION, Chiyoda-ku (JP)

(72) Inventors: Masaya Ota, Joetsu (JP); Shiho Sano, Joetsu (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 59 days.

(21) Appl. No.: 14/502,729

(22) Filed: Sep. 30, 2014

(65) Prior Publication Data

US 2015/0017583 A1 Jan. 15, 2015

Related U.S. Application Data

(63) Continuation of application No. PCT/JP2013/056858, filed on Mar. 12, 2013.

(30) Foreign Application Priority Data

Mar. 30, 2012 (JP) ..... 2012-082217

(51) Int. Cl.
*G03G 9/087* (2006.01)
*G03G 9/093* (2006.01)
(Continued)

(52) U.S. Cl.
CPC ..... *G03G 9/09335* (2013.01); *G03G 9/08* (2013.01); *G03G 9/0821* (2013.01);
(Continued)

(58) Field of Classification Search
CPC ..... G03G 9/087; G03G 9/08782
See application file for complete search history.

(56) References Cited

U.S. PATENT DOCUMENTS 7,217,488 B2 * 5/2007 Mikuriya ..... G03G 9/0825 430/110.2
8,163,451 B2 * 4/2012 Hirose ..... G03G 9/08782 430/108.21

(Continued)

FOREIGN PATENT DOCUMENTS

CN 101410762 A 4/2009
EP 1 688 799 A1 8/2006

(Continued)

OTHER PUBLICATIONS

International Search Report issued in corresponding PCT/JP2013/056858, dated Jun. 11, 2013.

(Continued)

*Primary Examiner* — Hoa V Le
(74) *Attorney, Agent, or Firm* — Oblon, McClelland, Maier & Neustadt, L.L.P.

(57) ABSTRACT

The object of the present invention is to provide a toner for development of electrostatic images (hereinafter referred to as toner) which, while preventing dust during fixation, secures improved hot offset resistance and is excellent in providing good image quality. The invention relates to the toner that comprises a binder resin, a colorant and a wax, wherein the wax has, while in a state of being contained in the toner, a melting point of from 55° C. to 90° C., and the value Dt of the toner satisfies a specific formula.

11 Claims, 9 Drawing Sheets

(51) Int. Cl.
*G03G 9/08* (2006.01)
*G03G 15/00* (2006.01)

(52) U.S. Cl.
CPC ..... *G03G 9/0825* (2013.01); *G03G 9/08733* (2013.01); *G03G 9/08782* (2013.01); *G03G 9/09314* (2013.01); *G03G 9/09357* (2013.01); *G03G 15/00* (2013.01)

(56) References Cited

U.S. PATENT DOCUMENTS 8,586,271 B2 * 11/2013 Asarese ..... G03G 9/0806 430/108.1
8,586,274 B2 * 11/2013 Yuge ..... G03G 9/08711 430/109.3
8,592,116 B2 * 11/2013 Pang ..... G03G 9/08782 430/108.3
8,614,044 B2 * 12/2013 Matsui ..... G03G 9/0806 430/108.4
8,637,632 B2 * 1/2014 Sasaki ..... C08G 63/81 502/168
8,642,239 B2 * 2/2014 Hong ..... G03G 9/0804 399/252
8,652,724 B2 * 2/2014 Wada ..... G03G 9/0806 430/108.1
8,663,887 B2 * 3/2014 Kaneda ..... G03G 9/08782 430/108.1
8,663,891 B2 * 3/2014 Lee ..... G03G 5/0535 430/108.8
8,673,528 B2 * 3/2014 Sugimoto ..... G03G 9/0806 430/108.2
8,778,585 B2 * 7/2014 Matsui ..... G03G 9/0806 430/108.4
8,828,639 B2 * 9/2014 Kamikura ..... G03G 9/0806 430/111.4
8,865,383 B2 * 10/2014 Suzuki ..... G03G 9/0804 430/105
8,916,324 B2 * 12/2014 Suzuki ..... G03G 9/0806 430/108.22
9,017,911 B2 * 4/2015 Kouyama ..... G03G 9/09733 430/108.4
9,081,316 B2 * 7/2015 Hong ..... G03G 9/0819
2005/0058927 A1 * 3/2005 Mikuriya ..... G03G 9/0825 430/110.2
2005/0208405 A1 * 9/2005 Ayaki ..... G03G 9/0806 430/108.4
2006/0172211 A1 * 8/2006 Ueda ..... G03G 9/0806 430/108.4
2007/0178397 A1 * 8/2007 Yamanouchi ..... G03G 9/0804 430/108.4
2007/0184374 A1 * 8/2007 Hirano ..... G03G 9/08782 430/108.8
2007/0238040 A1 * 10/2007 Veregin ..... G03G 9/0821 430/107.1
2007/0254229 A1 * 11/2007 Patel ..... G03G 9/0804 430/108.4
2008/0038654 A1 * 2/2008 Yamazaki ..... G03G 9/08704 430/110.3
2008/0160443 A1 7/2008 Yuasa et al.
2009/0041500 A1 2/2009 Mitsumori et al.
2009/0053634 A1 2/2009 Mitsumori et al.
2009/0061333 A1 * 3/2009 Matsumoto ..... G03G 9/0819 430/48
2009/0180807 A1 7/2009 Mitsumori et al.
2009/0291379 A1 11/2009 Oota et al.
2010/0316411 A1 12/2010 Mitsumori et al.
2010/0316412 A1 12/2010 Mitsumori et al.
2011/0311910 A1 12/2011 Matsui et al.
2012/0039630 A1 2/2012 Mitsumori et al.
2012/0045246 A1 2/2012 Mitsumori et al.
2013/0052578 A1 * 2/2013 Sugahara ..... G03G 9/08782 430/108.4
2013/0059250 A1 3/2013 Mitsumori et al.
2013/0143156 A1 6/2013 Mitsumori et al.
2013/0157185 A1 * 6/2013 Sakashita ..... G03G 9/08 430/105

FOREIGN PATENT DOCUMENTS

JP 2005-091706 4/2005
JP 2006-235028 9/2006
JP 2007-293319 11/2007
JP 2008-046464 2/2008
JP 2009-098680 5/2009
JP 2011-081042 4/2011
JP 2011-215502 10/2011
JP 2011-232552 A 11/2011
JP 2011-247942 A 12/2011
JP 2012-018249 1/2012
JP 2012-022313 2/2012
JP 2012-78809 A 4/2012

OTHER PUBLICATIONS

Decision of Refusal dated Oct. 25, 2016, in Japanese Patent Application No. 2013-050688 filed Mar. 13, 2013 (with English translation).
Notification of Reasons for Refusal dated Jul. 12, 2016, in Japanese Patent Application No. 2013-050688 filed on Mar. 13, 2013 (with English translation).
Extended European Search Report dated Feb. 19, 2016 in Patent Application No. 15186659.7.
Information submitted by third party on Nov. 30, 2015 in Japanese Patent Application No. 2013-050688 (with English Translation).
Office Action dated Jun. 29, 2017, in European Patent Application No. 15186659.7 filed Mar. 12, 2013.
Office Action dated Oct. 23, 2017, in Chinese Patent Application No. 201380018066.7 filed Mar. 12, 2013 (with English translation).
Notification of Reasons for Refusal dated Oct. 31, 2017, in Japanese Patent Application No. 2017-008788 filed Jan. 20, 2017 (with English translation).

* cited by examiner

[Fig. 1]
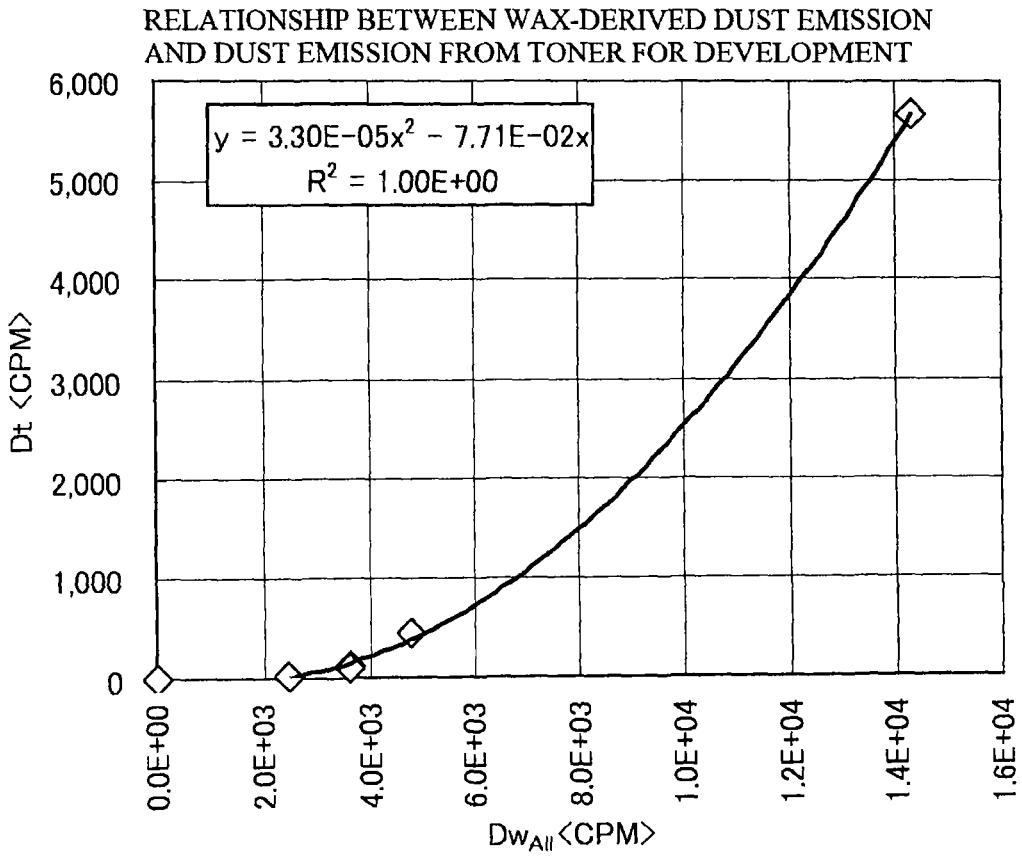

[Fig. 2]
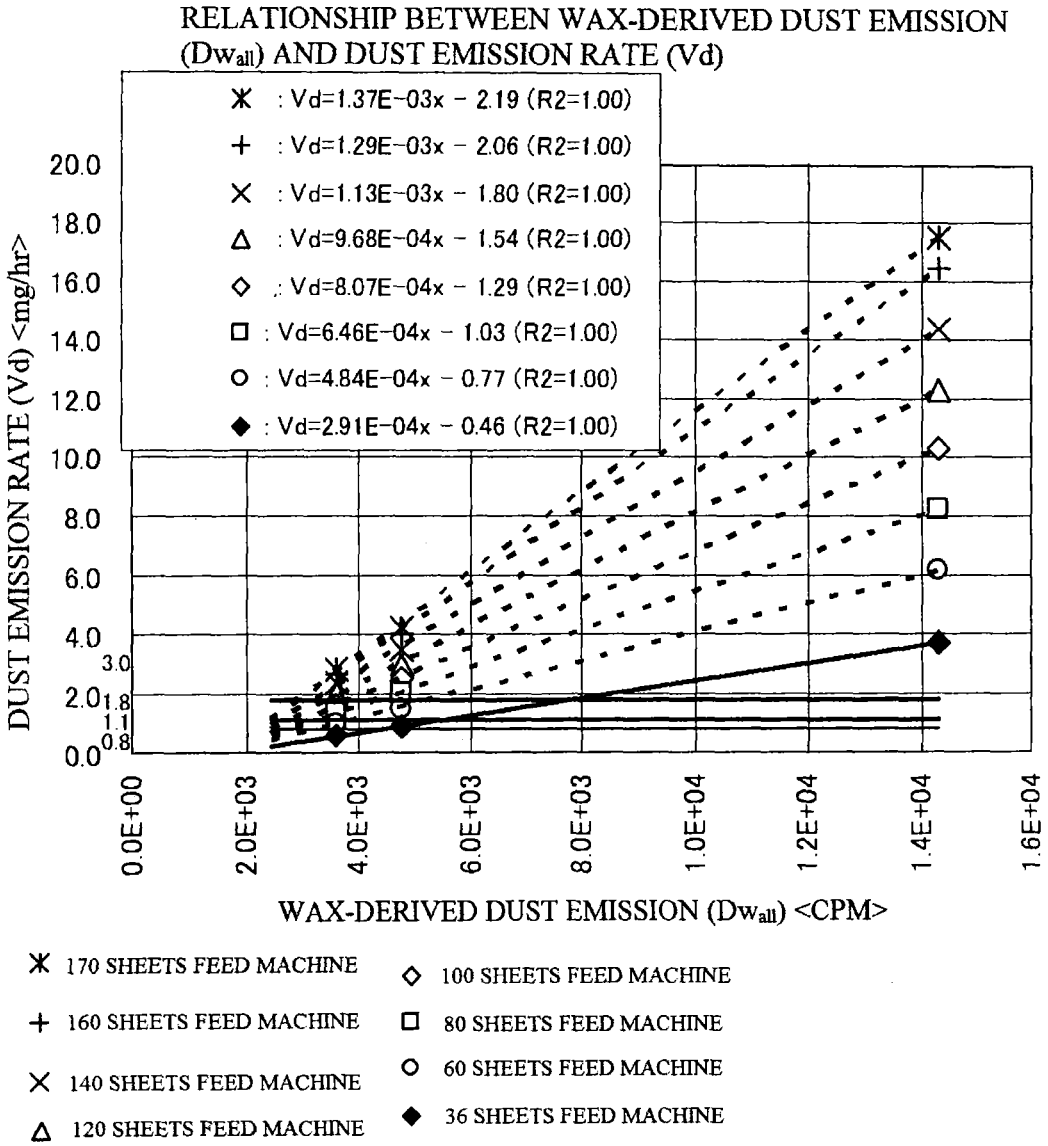

[Fig. 3]
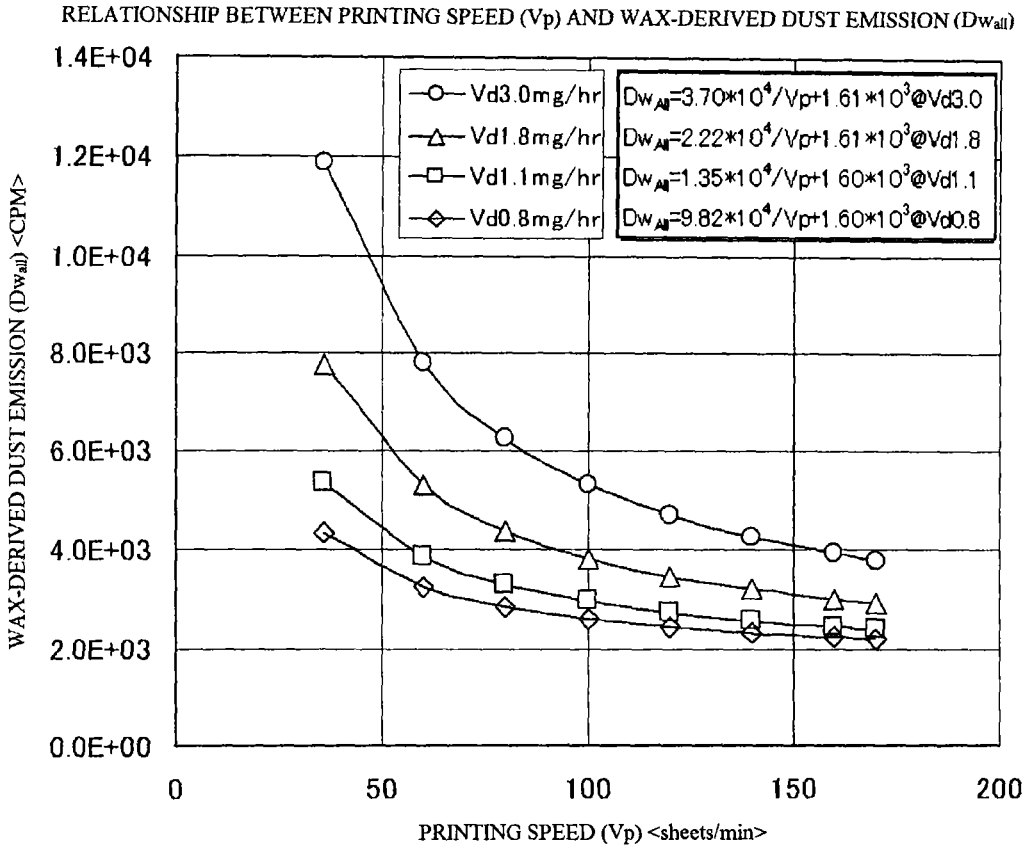

[Fig. 4]

RELATIONSHIP BETWEEN TONER DUST EMISSION AND DUST EMISSION RATE

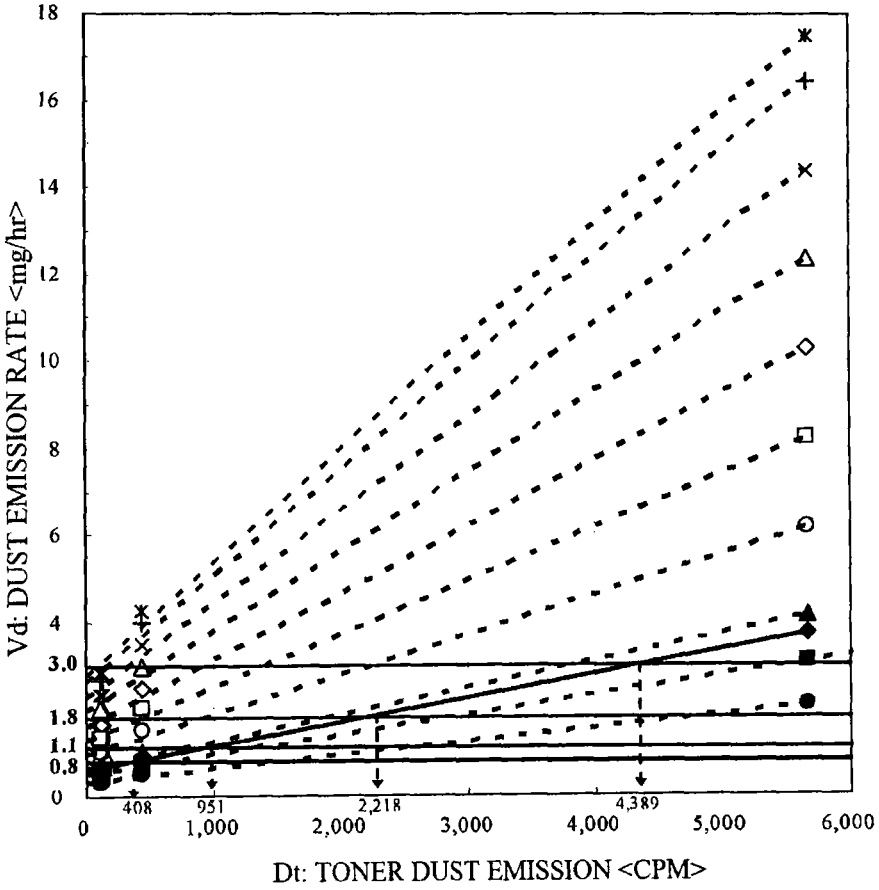

✱ 170 SHEETS FEED MACHINE ESTIMATED
+ 160 SHEETS FEED MACHINE ESTIMATED
× 140 SHEETS FEED MACHINE ESTIMATED
△ 120 SHEETS FEED MACHINE ESTIMATED
◇ 100 SHEETS FEED MACHINE ESTIMATED
□ 80 SHEETS FEED MACHINE ESTIMATED
○ 60 SHEETS FEED MACHINE ESTIMATED
▲ 40 SHEETS FEED MACHINE ESTIMATED
◆ 36 SHEETS FEED MACHINE
■ 30 SHEETS FEED MACHINE ESTIMATED
● 20 SHEETS FEED MACHINE ESTIMATED

[Fig. 5]
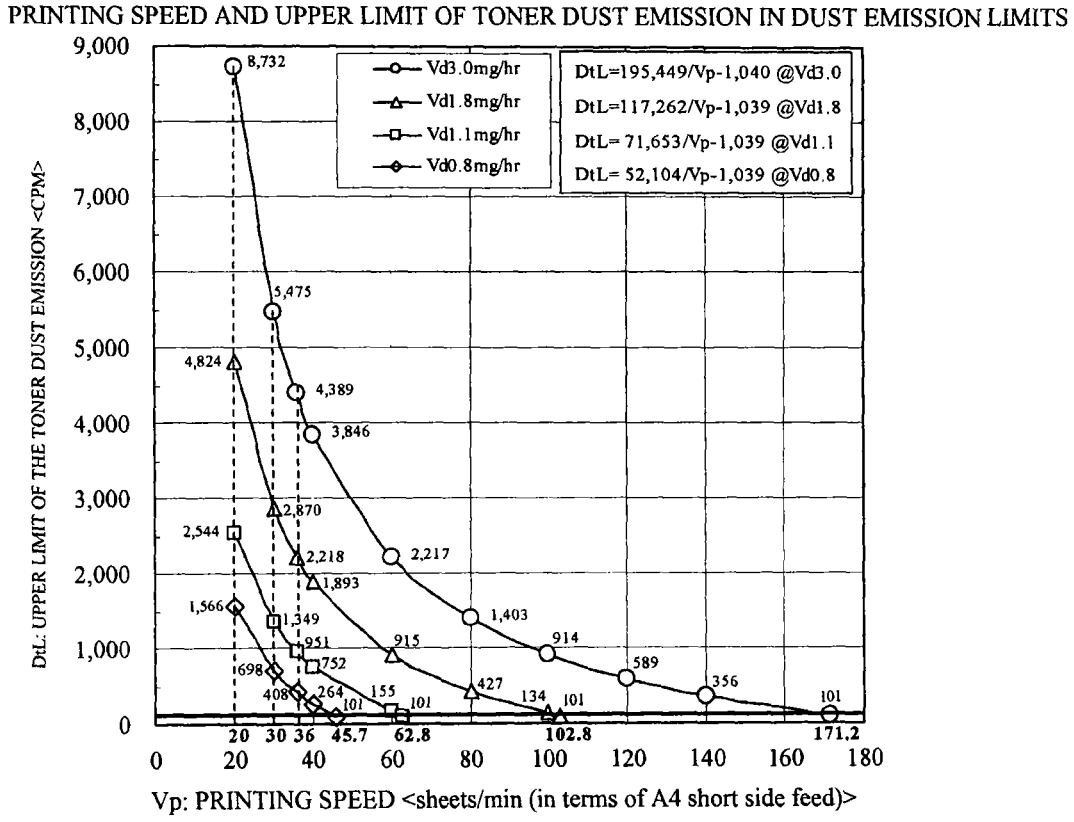

[Fig. 6]
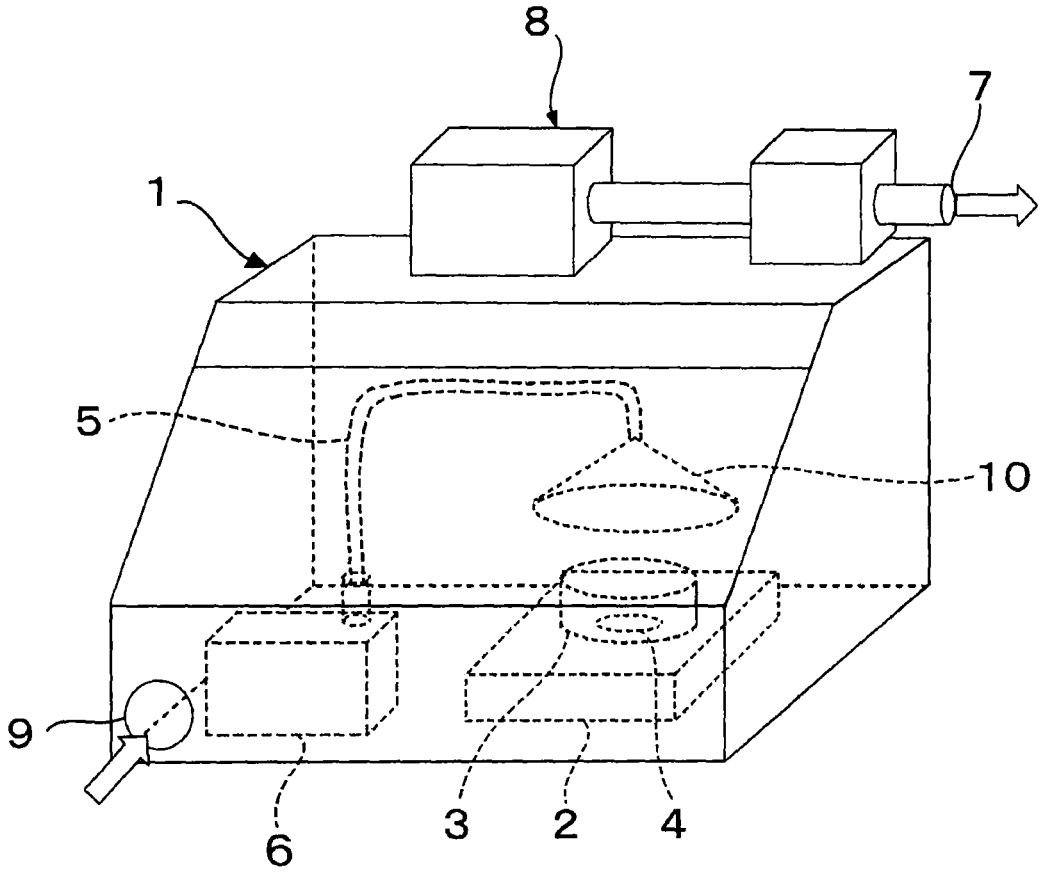

[Fig. 7]
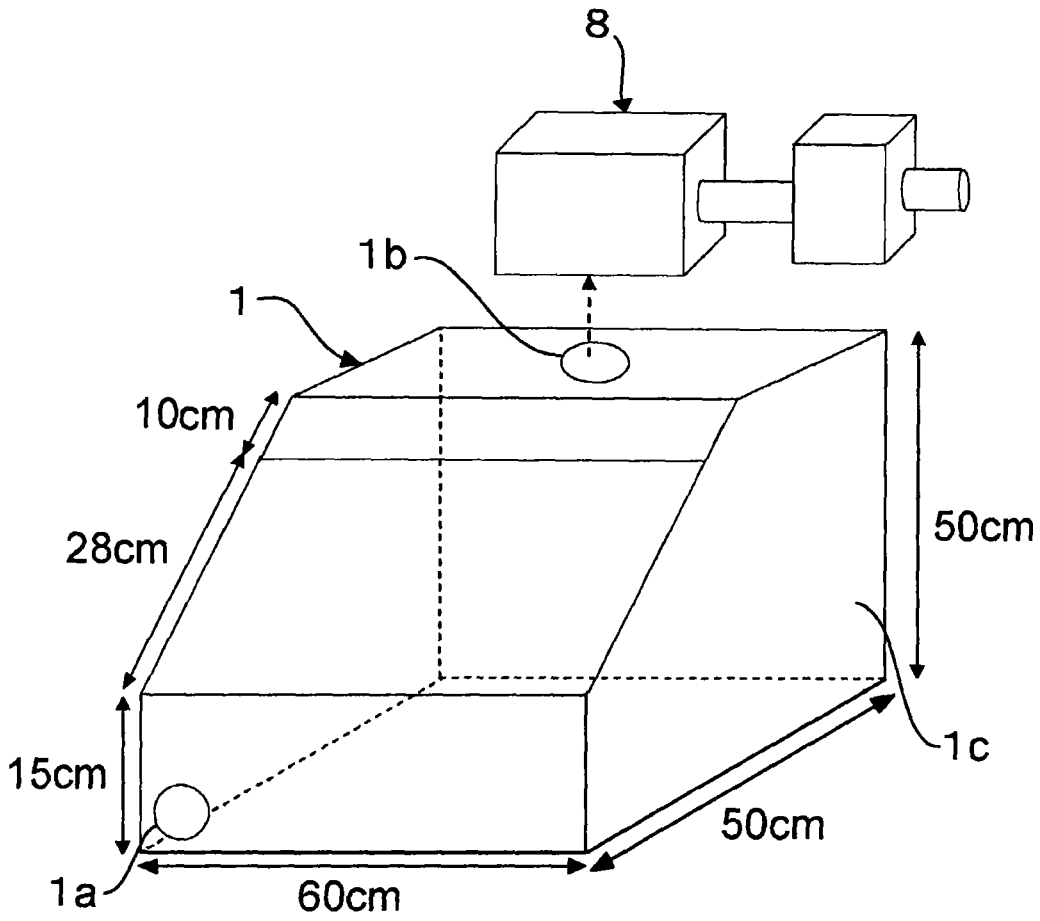

[Fig. 8]
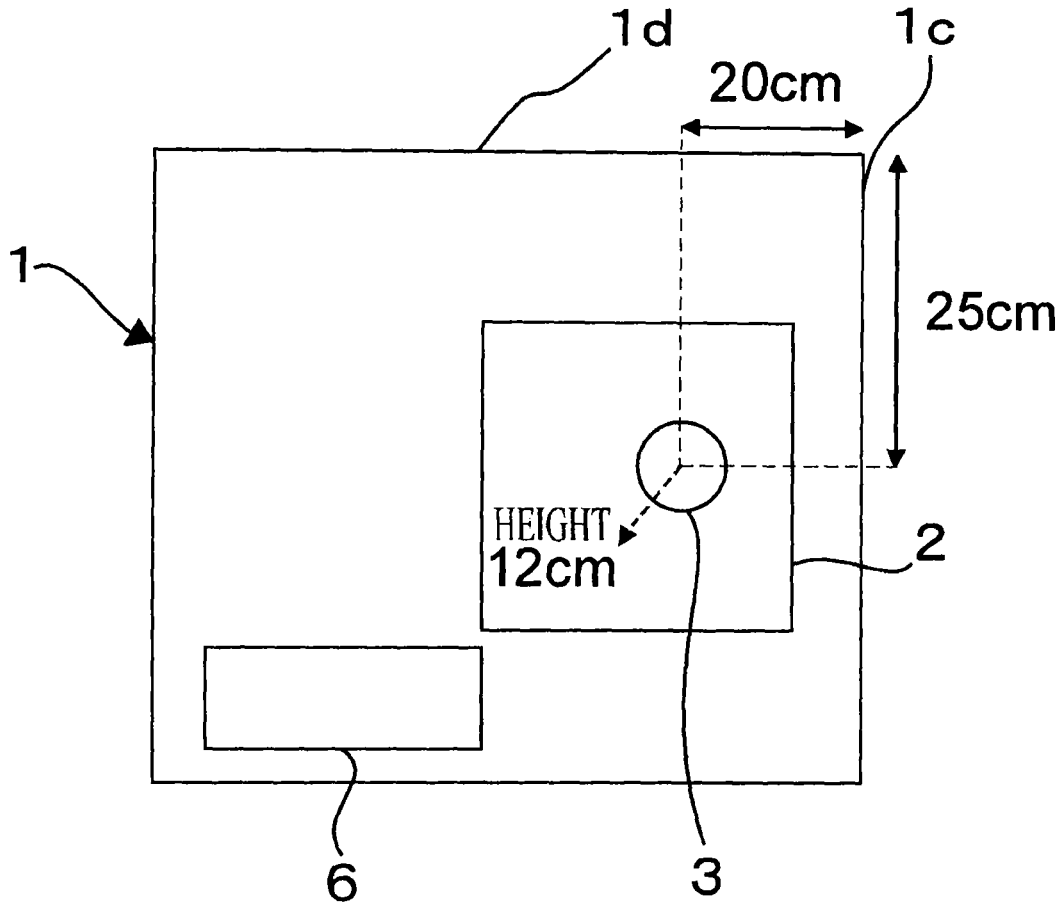

[Fig. 9]
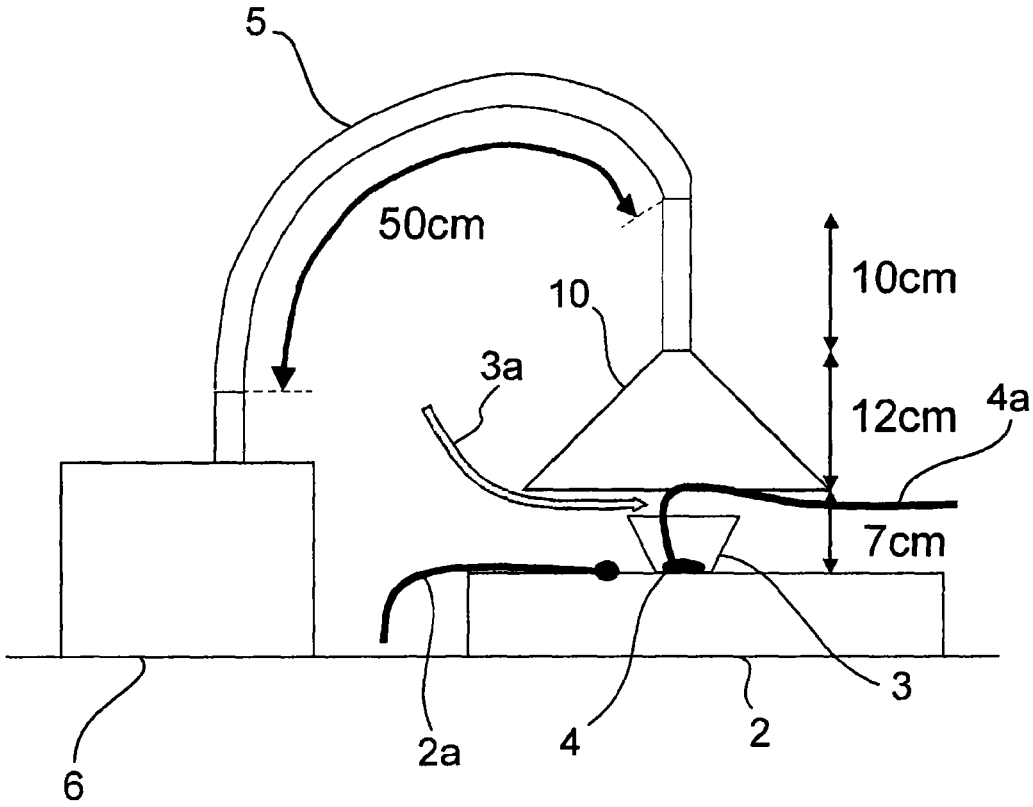
[Fig. 10]
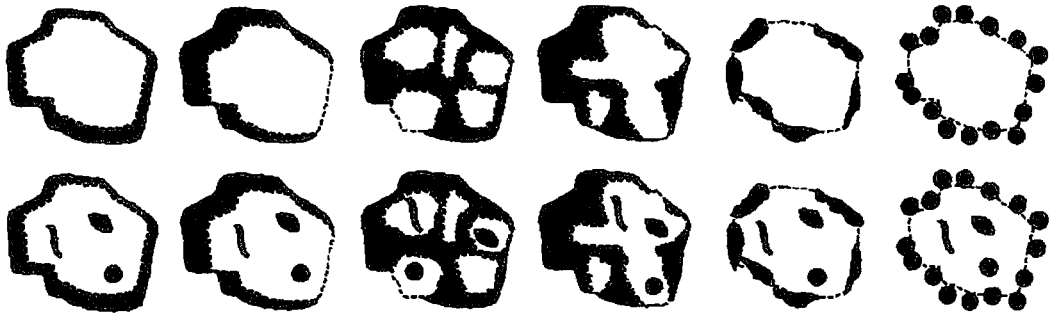

TONER FOR DEVELOPMENT OF ELECTROSTATIC IMAGES

TECHNICAL FIELD

The present invention relates to a toner for development of electrostatic images that is used in copiers and image forming devices in electrophotography.

BACKGROUND ART

With the recent popularization of copiers, printers and the like, environmental regulations on human health in office environments have become established mainly in Europe. Further, in high-speed printing, the amount of the toner to be consumed per unit time for development of electrostatic images increases, and therefore more volatile organic compounds and dust would be thereby diffused. In addition, the arena of electrophotography is expanding not only in the field of letter printing for the past office use or the like but also in the field of graphic use for photographic printing and others, and the amount per sheet of the toner to be used for development of electrostatic images is increasing exponentially. With such changes in needs, calls to providing a toner for development of electrostatic images that would hardly diffuse volatile organic compounds and dust even in a case where the amount of the toner to be consumed per unit time for development of electrostatic images is large in high-speed mass-scale printing are being strengthened year by year.

Recently, image forming devices certified by the most strict environmental standard, "The Blue Angel" have become increasing, and in electrophotographic fixation systems, the substances that are generated during high-temperature fixation and diffused out of the systems, concretely, dust by sublimation substances and volatile organic compounds are desired to be not more the controlled level regulated in ECMA-328/RAL_UZ122. Also in Japan, as the certification standards for the ecology mark for copiers, duplicators and the like, the regulation values of RAL_UZ122 are employed as they are at the time of re-revision in 2008, and the related devices are required to satisfy the standards.

Under the trend as above, for example, PTL 1 proposes a toner for development of electrostatic images which satisfies both low-temperature fixation capability and blocking resistance while preventing dust emission during fixation.

CITATION LIST

Patent Literature

PTL 1: JP-A 2011-81042

SUMMARY OF INVENTION

Technical Problem

However, the toner for development of electrostatic images proposed by PTL 1 is excellent in low-temperature fixation capability and blocking resistance while preventing dust emission during fixation, but could not satisfy hot offset resistance. Hot offset resistance as referred to herein means the performance of preventing the phenomenon of generating gloss unevenness that is referred to as blister to cause image degradation, which may occur owing to the release insufficiency and the internal cohesion power insufficiency of toner in melting of the toner by the heat given by a fixation device to lower the viscosity thereof, whereby the toner also adheres to the fixation roller side or the toner partially spread between the fixation roller and paper returns back to the paper side. In particular, in case where the amount of the toner adhering to paper in development of electrostatic images in graphic use increases, the hot offset resistance of the toner is not on a practicable level.

An object of the present invention is to provide a toner for development of electrostatic images which, while preventing dust emission during fixation, secures improved hot offset resistance in graphic use thereof where the amount of the toner to adhere to paper may increase, and which is excellent in providing good image quality.

Solution to Problem

The present inventors have assiduously studied for the purpose of solving the above-mentioned problems and, as a result, have found that, when the amount of the sublimation substance to be released by the toner (dust emission (Dt)) is controlled within a specific numerical range calculated from a specific formula, then there can be provided a toner capable of preventing dust emission during fixation and capable of having improved hot offset resistance, and have completed the present invention.

Specifically, the present invention includes the following:

[1] A toner for development of electrostatic images comprising a binder resin, a colorant and a wax, wherein:

the wax that is in a state of being contained in the toner for development of electrostatic images has at least one melting point falling within a range of from 55° C. to 90° C., and a dust emission (Dt) from the toner for development of electrostatic images satisfies the following formula (1):

$$101 \leq Dt \leq 195{,}449/Vp - 1{,}040 \quad (1)$$

[wherein Dt represents a dust emission per minute (CPM) when heating the toner for development of electrostatic images, Vp represents a printing speed (sheets/min) in terms of A4 short side feed in an image forming device, and Vp is 171.2 or less.]

[2] The toner for development of electrostatic images according to the [1] above, wherein the dust emission (Dt) from the toner for development of electrostatic images satisfies the following formula (2):

$$101 \leq Dt \leq 117{,}262/Vp - 1{,}039 \quad (2)$$

[wherein Dt represents a dust emission per minute (CPM) when heating the toner for development of electrostatic images, Vp represents a printing speed (sheets/min) in terms of A4 short side feed in an image forming device, and Vp is 102.8 or less.]

[3] The toner for development of electrostatic images according to the [2] above, wherein the dust emission (Dt) from the toner for development of electrostatic images satisfies the following formula (3):

$$101 \leq Dt \leq 71{,}653/Vp - 1{,}039 \quad (3)$$

[wherein Dt represents a dust emission per minute (CPM) when heating the toner for development of electrostatic images, Vp represents a printing speed (sheets/min) in terms of A4 short side feed in an image forming device, and Vp is 62.8 or less.]

[4] The toner for development of electrostatic images according to the [3] above, wherein the dust emission (Dt)

from the toner for development of electrostatic images satisfies the following formula (4):

$$101 \leq Dt \leq 52{,}104/Vp - 1{,}039 \quad (4)$$

[wherein Dt represents a dust emission per minute (CPM) when heating the toner for development of electrostatic images, Vp represents a printing speed (sheets/min) in terms of A4 short side feed in an image forming device, and Vp is 45.7 or less.]

[5] The toner for development of electrostatic images according to any one of the [1] to [4] above, wherein the value of Vp is 20 or more.

[6] The toner for development of electrostatic images according to any one of the [1] to [5] above, wherein the value of Vp is 30 or more.

[7] The toner for development of electrostatic images according to any one of the [1] to [6] above, wherein the wax that is in a state of being contained in the toner for development of electrostatic images has at least one melting point in a range of from 55° C. to lower than 70° C., and at least one melting point in a range of from 70° C. to 80° C.

[8] The toner for development of electrostatic images according to any one of the [1] to [7] above, wherein the toner for development of electrostatic images satisfies the following requirements (a) to (c):

(a) The toner for development of electrostatic images contains at least two types of waxes of a wax component X and a wax component Y, (b) The dust emission from the wax component Y is larger than the dust emission from the wax component X, (c) The content of the wax component X is larger than the content of the wax component Y.

[9] The toner for development of electrostatic images according to the [8] above, wherein the proportion of the wax component Y in all the wax components is from 0.1% by mass to less than 10% by mass.

[10] The toner for development of electrostatic images according to any one of the [1] to [9] above, wherein the toner for development of electrostatic images satisfies the following requirements (a), (b) and (d):

(a) The toner for development of electrostatic images contains at least two types of waxes of a wax component X and a wax component Y, (b) The dust emission from the wax component Y is larger than the dust emission from the wax component X, (d) The dust emission from the wax component X is 50,000 CPM or less, and the dust emission from the wax component Y is 100,000 CPM or more.

[11] The toner for development of electrostatic images according to any one of the [8] to [10] above, wherein the toner for development of electrostatic images has a region in which an abundance ratio of the wax component Y is larger than that of the wax component X, and the region exists more in the outer region of the toner for development of electrostatic images than in the center region thereof.

[12] The toner for development of electrostatic images according to any one of the [8] to [11] above, wherein the toner for development of electrostatic images has a shell/core structure, and the wax contained in the shell of the shell/core structure contains substantially the wax component Y alone, and the wax contained in the core of the shell/core structure contains substantially the wax component X alone.

[13] A toner for development of electrostatic images containing a binder resin, a colorant and a wax, wherein:

the wax that is in a state of being contained in the toner for development of electrostatic images has at least one melting point falling within a range of from 55° C. to 90° C., and the toner satisfies the following requirements (a), (b) and (f):

(a) The toner for development of electrostatic images contains at least two types of waxes of a wax component X and a wax component Y, (b) The dust emission from the wax component Y is larger than the dust emission from the wax component X, (f) The toner for development of electrostatic images has a region in which an abundance ratio of the wax component Y is larger than that of the wax component X, and the region exists more in the outer region of the toner for development of electrostatic images than in the center region thereof.

[14] The toner for development of electrostatic images according to the [13] above, wherein a dust emission from the wax component X is 50,000 CPM or less, and a dust emission from the wax component Y is 100,000 CPM or more.

[15] The toner for development of electrostatic images according to the [13] or [14] above, wherein the toner for development of electrostatic images has a shell/core structure, the wax contained in the shell of the shell/core structure contains substantially the wax component Y alone, and the wax contained in the core of the shell/core structure contains substantially the wax component X alone.

[16] The toner for development of electrostatic images according to any one of the [13] to [15] above, wherein the toner for development of electrostatic images has a shell/core structure, the wax contained in the shell of the shell/core structure contains substantially the wax component Y alone, and the wax contained in the core of the shell/core structure contains substantially the wax component X alone.

Advantageous Effects of Invention

According to the present invention, the dust emission during fixation of a toner for development can be reduced and the hot offset resistance thereof can be improved even in high-speed machines that may consume a large amount of toner for development of electrostatic images per unit time and even in a case where the amount of toner to adhere to paper for development of electrostatic images thereon may increase in graphic use.

BRIEF DESCRIPTION OF DRAWINGS

FIG. 1 is a graph showing a relationship between wax-derived dust emission ($Dw_{ALL}$) and dust emission (Dt) from toners for development of electrostatic images.

FIG. 2 is a graph showing a relationship between wax-derived dust emission ($Dw_{ALL}$) and dust emission rate (Vd).

FIG. 3 is a graph showing a relationship between printing speed (Vp) and wax-derived dust emission ($Dw_{ALL}$).

FIG. 4 is a graph showing a relationship between dust emission (Dt) from toners for development of electrostatic images and dust emission rate (Vd) from image forming devices. The horizontal axis shows the dust emission (Dt) in heating of toners in a static environment, and the vertical axis shows the dust emission per hour in continuous printing in image forming devices (dust emission rate: Vd).

FIG. 5 is a graph showing a relationship between printing speed (Vp) and upper limit of toner dust emission (DtL). The horizontal axis shows the printing speed (Vp) in terms of A4 short side feed, and the vertical axis shows the upper limit of the toner dust emission (DtL).

FIG. 6 is a view showing a schematic configuration of a dust detector.

FIG. 7 is an explanatory view showing tangible size data of the draft 1 of the dust detector shown in FIG. 6.

FIG. 8 is a plan view of a part of the dust detector shown in FIG. 6, as seen from the top thereof.

FIG. 9 is a view explaining the positional relationship in the height direction of the heating unit (hot plate) 2, the sample cup (aluminium cup) 3 and the cone collector 10, the size of the suction duct 5 connected to the cone collector 10, and the positional relationship in the height direction of the suction duct 5 and the dust counter 6, in the dust detector shown in FIG. 6.

FIG. 10 includes schematic views showing concrete examples of the condition of "the toner for development of electrostatic images that has a region where the abundance ratio of the wax component Y is larger than that of the wax component X, in which the region exists more in the outer region of the toner for development of electrostatic images than in the center region thereof".

DESCRIPTION OF EMBODIMENTS

The invention is described hereinunder; however, the invention is not limited to the following embodiments but can be carried out in any other modification. In this description, "% by weight" and "part by weight" each have the same meaning as "% by mass" and "part by mass", respectively.

The method for producing the toner for development of electrostatic images (hereinafter this may be abbreviated as "toner for development" or "toner") of the present invention is not specifically defined, for which the constitution mentioned below is employable in a production method for wet-method toner or ground toner.

<Toner for Development of Electrostatic Images>

The present invention provides a toner for development of electrostatic images that contains a binder resin, a colorant and a wax, wherein the wax that is in a state of being contained in the toner for development of electrostatic images has at least one melting point falling within a range of from 55° C. to 90° C., and the dust emission (Dt) from the toner for development of electrostatic images satisfies the following formula (1):

$$101 \leq Dt \leq 195{,}449/Vp - 1{,}040 \quad (1)$$

[wherein Dt represents the dust emission per minute (CPM (counter per minute))) in heating the toner in a static environment, Vp represents the printing speed (sheets/min) in terms of A4 short side feed in an image forming device, and Vp is 171.2 or less.]

Here, the toner dust means the substance to be released from and emitted by the toner when heated, and the toner dust emission (Dt) is a value measured by analyzing the toner for development of electrostatic images according to the method described in the section of Examples given hereinunder, using a dust counter (SIBATA's digital dust indicator LD-3K2).

The image forming device for Vp includes printers, copiers, facsimiles, etc.

The printing speed (sheets/min) in terms of A4 short side feed for standardizing Vp indicates the number of printable sheets per minute in printing on A4-size sheets in the direction of the short axis thereof. The A4-size sheet has a size of 297 mm×210 mm, and therefore the A4 short side is 210 mm long.

Regarding the wax therein, the toner must indispensably contain a wax having, as in a state of being contained therein, a melting point not higher than 90° C. (hereinafter this is referred to as the melting point of wax) in order that the toner for development of electrostatic images could be given a sufficient fixation performance. This is because a wax having a too high melting point would have a low diffusion speed from the toner when the toner is melted in a fixation unit even though the sublimation energy thereof is sufficiently low and, as a result, the wax could not move to the toner surface and therefore could not impart sufficient lubrication performance.

On the other hand, a wax having a too low melting point would lower the heat resistance of the toner and may additionally provide a problem of blocking during transportation, and therefore the wax of the type could not be used. Consequently, the toner indispensably contains a wax having a melting point not lower than 55° C.

The melting point of the wax itself is from 55° C. to 90° C. The melting point of the wax that is in a state of being contained in the toner for development of electrostatic images is a value measured according to the method described in the section of Examples given hereinunder. Using a thermal analyzer (DSC), the toner is analyzed in the condition where the peak (heat history) derived from the enthalpy relaxation at the glass transition point of the resin in the toner has disappeared.

The value 101 on the left-hand side of the formula (1) is the lower limit of the toner dust emission (Dt) that does not cause hot offset. In other words, when the dust emission (Dt of the toner for development of electrostatic images is less than 101, the absolute amount of the release component that comprises mainly wax capable of subliming on the fixation roller surface from the toner for development of electrostatic images having statically adhered to paper would be too small, and therefore the toner could not be given sufficient releasability and may cause hot offset.

The lower limit of the toner dust emission (Dt) not causing hot offset, shown on the left-hand side of the formula (1), is a numerical value calculated by multiplying the actually-measured, hot offset-free value by the measurement accuracy of the dust indicator. The actually-measured, hot offset-free value is a value not causing hot offset in actually measuring the dust emission under a predetermined condition, using a dust indicator (SIBATA's digital dust indicator LD-3K2) in the dust detection apparatus shown in the section of Examples given hereinunder. The speed accuracy of the dust counter is multiplied for the purpose of considering the measurement accuracy of the dust counter.

For example, in Examples and Comparative Examples given below, the dust emission (Dt) from the toner not causing hot offset is 112 (CPM) (for example, in Example 3). The measurement accuracy of the dust counter (SHIBATA's digital dust indicator LD-3K2) with which the toner dust emission is measured in Examples and Comparative Examples in the present invention is ±10%, and therefore the lower limit of the toner dust emission is the numerical value 101 that is calculated by multiplying the hot offset-free toner dust emission (Dt) 112 by 0.9.

In the present invention, the toner dust emission (Dt) may be measured, for example, using the dust detector disclosed in JP-A 2010-2338. The dust amount detected using the dust detector may be measured using a dust counter (SIBATA's digital dust indicator LD-3K2).

The right-hand side of the formula (1) is determined from the upper limit of the toner dust emission (DtL) necessary for controlling the dust emission per hour in continuous printing (dust emission rate: Vd) to be 3.0 or less. The numerical formula 195,449/Vp−1,040 to be the value on the right-hand side is the function that is necessarily derived from the found values of the toner dust emission (Dt) and the dust emission rate (Vd) measured under the condition shown in Examples.

The lower limit shown by the left-hand side of the formula (1) varies depending on the toner dust emission environment and on the dust detector, and the numerical value shown by the right-hand side of the formula (1) varies depending on the set value of the dust emission per hour in continuous printing in an image forming device (dust emission rate: Vd). In case where the toner dust emission environment and the dust detector condition are under the same condition, different image forming devices each having a different printing speed (Vp) may prevent dust emission during fixation and may prevent hot offset so far as the condition of the formula (1) is satisfied.

The function on the right-hand side is described below.

FIG. 4 is a graph showing a relationship between dust emission (Dt) from toners for development of electrostatic images and dust emission rate (Vd) from image forming devices. The horizontal axis shows the dust emission (Dt) in heating of toners in a static environment, and the vertical axis shows the dust emission per hour in continuous printing in image forming devices (dust emission rate: Vd). The rising diagonal solid line on the drawing is drawn by connecting the four found data in continuous printing of 36 sheets in terms of A4 short side feed per minute (Vp=36) in a primary linear equation according to the least squares method. The primary linear equation indicates $Vd=5.53\times10^{-4}\times Dt+0.574$, and the square of the correlation coefficient thereof is 0.999. Accordingly, it is known that the dust emission from the image forming device (dust emission rate: Vd) is in primary linear proportion to the toner dust emission (Dt). Here, for the dust emission (dust emission rate: Vd), the amount of the dust collected according to the measurement method certified by the Blue Angel (RAL UZ122 2006) is measured according to the method described in the section of Examples given below.

Further, as described above, the image forming device where the number of sheets to be printed per unit hour is large consumes a large amount of the toner for development of electrostatic images and therefore emits a large amount of dust, and the dust amount (dust emission rate: Vd) is proportional to the printing speed.

For example, regarding a device where one sheet is printed in one minute and a device where two sheets are printed in one minute, the latter consumes toner in an amount of two times in the former, and therefore the dust emission from the latter image forming device is two times that from the former. In other words, from the actually measured values of the dust emission (Dt) from the toner for development of electrostatic images in continuous printing at a printing speed of 36 sheets/min and the dust emission (dust emission rate: Vd) from the image forming device using the toner for development of electrostatic images, the dust emission (dust emission rate: Vd) emitted from the image forming device in which the printing speed changes is calculated proportionally, and the calculated values are connected in a primary linear equation according to the least squares method, therefore giving the dotted lines in FIG. 4.

A more detailed explanation is given here. In FIG. 4, when the dust emission rate (Vd) of the toner for development of electrostatic images in an image forming device at a printing speed of 36 sheets/min in terms of A4 short side feed is 3.7 (mg/hr), the measured value of the toner dust emission (Dt) is 5,665 (CPM). In case where it is estimated that, using the toner for development of electrostatic images, when the printing speed in terms of A4 short side feed is increased up to 120 sheets/min, then dust emission from the toner for development in the image forming device (dust emission rate: Vd) is proportional to the increased printing speed, and is therefore $(120/36)\times3.7=12.3$ (mg/hr). The dust emission (Dt) of the toner for development of electrostatic images is 5,665 (CPM), and therefore in FIG. 4, the point at which the horizontal axis (toner dust emission: Dt) is 5,665 and the vertical axis (dust emission rate: Vd) is 12.3 is given a dot of Δ (triangle).

In that manner in FIG. 4, from Examples and Comparative Examples given below, the solid line is drawn by connecting the measured results in a primary linear equation from the toner dust emission (Dt) actually measured at a printing speed of 36 sheets/min in terms of A4 short side feed, and the dust emission rate (Vd) per hour from the image forming device using the toner, according to the least squares methods.

The dotted lines are drawn as follows: From the actually measured results, the dust amount emitted from the image forming device (dust emission rate: Vd) is proportionally calculated with change in the printing speed in the device, and the dotted line indicates the relationship between the toner dust emission (Dt) at each printing speed (Vp) and the dust emission rate (Vd) from the image forming device.

Further, in FIG. 4, a horizontal line with Vd=3.0 is drawn. The horizontal axis value on the intersection coordinates of the horizontal line and the dotted line and the solid line drawn from the relationship between the toner dust emission (Dt) and the dust emission rate (Vd) from the image forming device in a primary linear equation using the least squares method shows the upper limit of the toner dust emission (DtL) in the case where the dust emission rate (Vd) is set at the specific value of 3.0 or less.

In FIG. 5, each printing speed (Vp) is shown by the horizontal axis, and the upper limit of the toner dust emission (DtL) is by the vertical axis. As shown in FIG. 5, it is obvious that, when the printing speed is higher, then the toner to be consumed per unit hour for development of electrostatic images increases more, and therefore for controlling the dust emission to be not more than a specific level (for example, not more than a regulated value), the upper limit of the dust emission from the toner for development of electrostatic images per unit mass must also be controlled to be small.

In FIG. 5, the relationship between the printing speed (Vp) and the upper limit of the toner dust emission (DtL) shown by the O (circular) dots is given an inversely proportional formula using the least squares method, then a formula of DtL=195,449/Vp−1,040 is established for the upper limit of the toner dust emission (DtL). This is the upper limit of the toner dust emission (DtL) at each printing speed (Vp), and the right-hand side of the formula (1) corresponds thereto.

It is desirable that the dust amount (dust emission rate: Vd) to be emitted per hour in continuous printing in an image forming device is smaller, and in order that the preferred dust emission rate (Vd) could satisfy a specific value of 1.8 or less, it is desirable that the dust emission (Dt) from the toner for development of electrostatic images satisfies the formula (2).

$$101 \leq Dt \leq 117{,}262/Vp - 1{,}039 \quad (2)$$

The formula (2) is a requirement for controlling the dust amount to be emitted per hour from an image forming device (dust emission rate: Vd) to be the preferred specific value of 1.8 or less, and in the same manner as that for the method of determining the formula (1), the formula indicates the function that is necessarily determined from the actually measured data of the toner dust emission (Dt) and the dust emission rate (Vd) from the toner for development of electrostatic images as shown in Examples.

Concretely, in FIG. 4, the horizontal axis value on the intersection coordinates of the horizontal line with Vd=1.8 and the dotted line drawn from the relationship between the toner dust emission (Dt) and the dust emission rate (Vd) from the image forming device in a primary linear equation using the least squares method shows the upper limit of the toner dust emission (DtL) in the case where the dust emission rate (Vd) is set at the specific value of 1.8 or less. With that, as shown in FIG. 5, the value of each printing speed (Vp) on the horizontal axis and the value of the upper limit of each toner dust emission (DtL) on the vertical axis are shown by Δ (triangular) dots, and the relationship between the printing speed (Vp) and the upper limit of the toner dust emission (DtL) shown by the Δ (triangular) dots is given an inversely proportional formula using the least squares method, then a formula of DtL=117,262/(Vp−1,039) is established for the upper limit of the toner dust emission DtL. This is the upper limit of the toner dust emission (DtL) at each printing speed (Vp), corresponding to the right-hand side of the formula (2).

In order that the dust amount to be emitted per hour in continuous printing in an image forming device (dust emission rate) (Vd) is made to have a more preferred value of 1.1 or less, it is more desirable that Dt satisfies the following formula (3):

$$101 \leq Dt \leq 71{,}653/Vp - 1{,}039 \quad (3)$$

The formula (3) is a requirement for controlling the dust amount to be emitted per hour from an image forming device (dust emission rate: Vd) to be the preferred specific value of 1.1 or less, and in the same manner as that for the method of determining the formula (1), the formula indicates the function that is necessarily determined from the actually measured data of the toner dust emission (Dt) and the dust emission rate (Vd) from the toner for development of electrostatic images as shown in Examples.

Concretely, in FIG. 4, the horizontal axis value on the intersection coordinates of the horizontal line with Vd=1.1 and the dotted line drawn from the relationship between the toner dust emission (Dt) and the dust emission rate (Vd) from the image forming device in a primary linear equation using the least squares method shows the upper limit of the toner dust emission (DtL) in the case where the dust emission rate (Vd) is set at the specific value of 1.1 or less. With that, as shown in FIG. 5, the value of each printing speed (Vp) on the horizontal axis and the value of the upper limit of each toner dust emission (DtL) on the vertical axis are shown by □ (square) dots, and the relationship between the printing speed (Vp) and the upper limit of the toner dust emission (DtL) shown by the □ (square) dots is given an inversely proportional formula using the least squares method, then a formula of DtL=71,653/Vp−1,039 is established for the upper limit of the toner dust emission DtL. This indicates the relationship of the upper limit of the toner dust emission (DtL) at each printing speed (Vp), corresponding to the right-hand side of the formula (3).

In order that the dust amount to be emitted per hour in continuous printing in an image forming device (dust emission rate) (Vd) is made to have a most preferred value of 0.8 or less, it is even more desirable that the toner dust emission (Dt) satisfies the following formula (4):

$$101 \leq Dt \leq 52{,}104/Vp - 1{,}039 \quad (4)$$

The formula (4) is a requirement for controlling the dust amount to be emitted per hour from an image forming device (dust emission rate: Vd) to be the preferred specific value of 0.8 or less, and in the same manner as that for the method of determining the formula (1), the formula indicates the function that is necessarily determined from the actually measured data of the toner dust emission (Dt) and the dust emission rate (Vd) from the toner for development of electrostatic images as shown in Examples. Concretely, in FIG. 4, the horizontal axis value on the intersection coordinates of the horizontal line with Vd=0.8 and the dotted line drawn from the relationship between the toner dust emission (Dt) and the dust emission rate (Vd) from the image forming device in a primary linear equation using the least squares method shows the upper limit of the toner dust emission (DtL) in the case where the dust emission rate (Vd) is set at the specific value of 0.8 or less. With that, as shown in FIG. 5, the value of each printing speed (Vp) on the horizontal axis and the value of the upper limit of each toner dust emission (DtL) on the vertical axis are shown by ◇ (diamond) dots, and the printing speed (Vp) shown by the ◇ (diamond) dots is given an inversely proportional formula using the least squares method, then a formula of DtL=52,104/Vp−1,039 is established for the upper limit of the toner dust emission DtL. This indicates the upper limit of the toner dust emission (DtL) at each printing speed (Vp), corresponding to the right-hand side of the formula (4).

In order that the dust emission Dt from the toner for development of electrostatic images satisfies the range of the above-mentioned formula (1), it will be only necessary to suitably select the wax, the binder resin, the colorant, the additive and the other substance to be in the toner and to suitably control the amount thereof. In particular, the main factor of dust is wax, and therefore when the a substance suitable for wax at the sublimation energy thereof is selected and when the amount thereof is controlled, then the dust emission Dt from the toner for development of electrostatic images can be controlled to fall within the range of the above-mentioned formula (1).

Similarly, in order that the dust emission Dt can satisfy the range of the formula (2), it is desirable to select a wax from which the dust emission is smaller than that from the wax selected for the formula (1), or to reduce the amount of the wax to be added.

Also, in order that the dust emission Dt can satisfy the range of the formula (3), it is desirable to select a wax from which the dust emission is smaller than that from the wax selected for the formula (2), or to reduce the amount of the wax to be added.

Further, in order that the dust emission Dt can satisfy the range of the formula (4), it is desirable to select a wax from which the dust emission is smaller than that from the wax selected for the formula (3), or to reduce the amount of the wax to be added.

It may be said that, as compared with the toner for development of electrostatic images that satisfies the formula (1) alone, the toner for development of electrostatic images that satisfies the formula (2) is more preferred from the viewpoint that the dust emission rate from the toner can be reduced more in a high-speed image forming device (having a high printing speed per unit hour). Similarly, it may be said that, as compared with the toner for development of electrostatic images that satisfies the formulae (1) and (2) alone, the toner for development of electrostatic images that satisfies the formula (3) is more preferred, and as compared with the toner for development of electrostatic images that satisfies the formulae (1) to (3), the toner for development of electrostatic images that satisfies the formula (4) is more preferred, from the viewpoint that the dust emission rate from those toners can be reduced more in a high-speed image forming device (having a high printing speed per unit hour).

In order that the dust emission Dt from the toner for development of electrostatic images can satisfy the range of the above-mentioned formula (1), it may be only necessary to prepare the toner for development of electrostatic images, for example, according to the following method (I) or (II):

(I) The toner for development of electrostatic images contains a binder resin, a colorant and a wax, in which the wax that is in a state of being contained in the toner has at least one melting point falling within a range of from 55° C. to 90° C., and which satisfies the following (a) to (c):

(a) The toner for development of electrostatic images contains at least two types of waxes of a wax component X and a wax component Y.

(b) The dust emission from the wax component Y is larger than the dust emission from the wax component X.

(c) The content of the wax component X is larger than the content of the wax component Y.

(II) The toner for development of electrostatic images contains a binder resin, a colorant and a wax, in which the wax that is in a state of being contained in the toner has at least one melting point falling within a range of from 55° C. to 90° C., and which satisfies the following (a), (b) and (e):

(a) The toner for development of electrostatic images contains at least two types of waxes of a wax component X and a wax component Y.

(b) The dust emission from the wax component Y is larger than the dust emission from the wax component X.

(e) The balance between the wax component X and the wax component Y is controlled in point of the wax dust emission and the wax content.

The wax dust emission and the wax content in the above (b) and (e) are described in detail.

The wax dust emission from the wax component X is represented by $Dw_X$ and the wax dust emission from the wax component Y is represented by $Dw_Y$, the concentration of each wax in the toner for development of electrostatic images is represented by $Cw_X$ and $Cw_Y$, respectively, and the following formula is taken into consideration.

$$DW_{ALL}=\Sigma Dw_X \cdot Cw_X/100=(Dw_X \times Cw_X+Dw_Y \times Cw_Y)/100 \quad (5)$$

In the above formula (5), $Dw_{ALL}$ represents the wax-derived dust emission and is a value derived through calculation, and this is a value indicating the emission in the case where all the wax components contained in the toner are emitted. In other words, this is a product of the emission from the wax alone and the content of the emitted wax in the toner. In case where the toner contains multiple waxes such as the wax component X and the wax component Y, then the total of the products thereof is $Dw_{ALL}$.

The definition and the measurement method of the wax dust emission are as described in the section of Examples.

The concentration of the wax in the toner for development of electrostatic images may be calculated from the formulation of the toner.

The details of Examples 1 to 3 and Comparative Examples 1 and 2 are described hereinunder. In FIG. 1, the value of $DW_{ALL}$ (CPM) of each of these is on the horizontal axis, and Dt (the dust emission per minute in heating the toner for development of electrostatic images) is on the vertical axis.

Fitting with the quadratic function with the intercept taken as zero according to the least squares method leads the following formula:

$$Dt=3.30\times10^{-5}\times DW_{ALL}^2-7.71\times10^{-2}\times DW_{ALL}(R^2=1.00) \quad (6)$$

The square of the above correlation coefficient is 1.00, and it is understood that the dust emission Dt from the toner is almost determined by $DW_{ALL}$, or that is, by the dust emission from the wax existing in the toner and the content of the wax existing in the toner.

Next, from FIG. 4 to be described below, Dt is converted into $Dw_{ALL}$, and the relationship thereof with the dust emission rate Vd is referred to. It is understood that the primary linear fitting as shown in FIG. 2 is applicable thereto. Here, the square of the correlation coefficient is 1.00, and it is known that Vd and $Dw_{ALL}$ show extremely high correlativity to each other.

Further, similarly to FIG. 4, when a horizontal line is drawn to connect the values Vd of 3.0, 1.8, 1.1 and 0.8 that are the critical points of the dust emission rate Vd in the present invention, then the value on the X-coordinate at the intersection between the horizontal line and the primary linear equation is the maximum value of the wax-caused dust emission $Dw_{ALL}$ corresponding to the printing speed in the image forming device.

In FIG. 3, the maximum value of $Dw_{ALL}$ at the intersection is plotted on the vertical axis and the printing speed Vp at the value is plotted on the horizontal axis. As described above, Dt and $Dw_{ALL}$ are correlated to each other and are defined unambiguously, and accordingly, FIG. 3 is the same as FIG. 5 to be mentioned below in which Dt is converted into $Dw_{ALL}$.

Like in FIG. 5, $Dw_{ALL}$ is in the form of a function inversely proportional to Vp in FIG. 3 and the square of the correlation coefficient is 1.00 therein, and accordingly, it may be said that an extremely good correlation is shown.

Specifically, when the printing speed of a planned image forming device is settled, then the upper limit of the wax-derived dust emission $Dw_{ALL}$ can be derived for every acceptable level of the dust emission rate Vd from the image forming device.

From the above, the qualitative orientation to make the dust emission Dt from the toner for development of electrostatic images satisfy the range of the above-mentioned formula (1) is shown below.

(A) When the dust emission from wax is large, then the hot offset resistant (HOS) could be better, but on the other hand, the dust emission rate Vd from an image forming device increases.

(B) When the wax content is large, then HOS could be better but, on the other hand, the dust emission rate Vd from an image forming device increases.

(C) When the dust emission from wax is too small, then HOS may worsen, but the dust emission rate Vd from an image forming device decreases.

(D) When the wax content is too small, then HOS may worsen, but the dust emission rage Vd from an image forming device decreases.

(E) When the printing speed Vp is low, then the dust amount to be emitted per unit time decreases and Vd decreases.

(F) When the printing speed Vp is high, then the dust amount to be emitted per unit time increases and Vd increases.

(G) When the threshold level of Vd is lowered, then a wax from which the dust emission is large would be difficult to select and further the wax content in the toner would be difficult to increase, and accordingly, the printing speed would also be difficult to increase.

From the above, for obtaining the toner of the present invention, it is important to control the dust emission Dt from the toner. For this, it may be said that selection of wax and control of the wax content are the most important.

Next, the acceptable maximum level of the wax content in selecting any unprescribed wax is described.

First, the printing speed Vp in an image forming device is set as an arbitrary value. This is a planning requirement for an image forming device, and it is necessary that the dust emission rate Vd from the image forming device at the printing speed is controlled to be 3.0 or less.

Vp is the value on the X axis in FIG. 3, and the value on the Y axis is thereby settled on the curve with Vd=3.0 mg/hr (circle mark, ○, in FIG. 3). When the value on the Y axis is thus settled, then the acceptable maximum value for attaining the dust emission rate (Vd) from the image forming device of 3.0 mg/hr or less is thereby settled relative to the wax-derived dust emission ($Dw_{ALL}$).

Subsequently, the dust emission (Dw) from the wax to be used is measured according to the method described in the section of Examples.

Consequently, the values of Dw and $Dw_{ALL}$ are settled. Simplifying the relational formula of the above formula (5) gives $Cw=Dw_{ALL}/Dw$, and assigning the actual values to $Dw_{ALL}$ and Dw gives Cw.

From the above, it is possible to derive the acceptable maximum concentration of wax (acceptable maximum wax amount) in the toner that is acceptable for attaining the dust emission rate (Vd) of 3.0 mg/hr or less at an unprescribed Vp.

Simplifying the above introduction method, the acceptable maximum wax may be determined according to the following process.

(a-1) Vp is settled as an unprescribed value.

(a-2) Vp thus settled in the above (a-1) is assigned to the numerical formula of $Dw_{ALL}=3.70\times10^4/Vp+1.61\times10^3$ in FIG. 3 to thereby determine $Dw_{ALL}$.

(a-3) The dust emission (Ew) from the wax to be used is measured according to the method described in the section of Examples.

(a-4) $Dw_{ALL}$ determined in the above (a-2) and Dw measured in the above (a-3) are assigned to the relational formula of $Cw=Dw_{ALL}/Dw$ to give Cw.

As in the above, when an unprescribed Vp and an unprescribed wax are selected, the acceptable maximum wax concentration that may be in the toner can be determined.

As described above, in case where the dust emission from wax is too small, then HOS may worsen. Accordingly, in the toner of the present invention, not only the acceptable maximum wax concentration but also the minimum wax content in the toner of the present invention are defined.

As a result of investigations made in Examples and Comparative Examples to be described hereinunder, when the dust emission Dt from the toner of the present invention is lower than 101 and when a fixation roller could not be given sufficient releasability, then HOS may worsen. Consequently, it is indispensable that Dt is planned to be 101 or more.

From FIG. 1, Dt and $Dw_{ALL}$ have the relationship of the above-mentioned formula (6). Assigning 101 to Dt in the formula (6) unambiguously defines $Dw_{ALL}$.

As a result of calculation of $Dw_{ALL}$, the dust emission Dw from the selected wax can be measured according to the method described in the section of Examples and $Dw_{ALL}/Dw$ in the relational formula $Cw=Dw_{ALL}/Dw$ can be thereby determined to give the value Cw. Cw thus determined here is the minimum wax content in the case of selecting the unprescribed wax.

Simplifying the above-mentioned introduction method, the acceptable minimum wax can be determined according to the following process.

(b-1) 101 is assigned to Dt in the formula (6) to determine $Dw_{ALL}$. ($Dw_{ALL}$=3,272.)

(b-2) The dust emission Dw from the wax used is measured according to the method described in the section of Examples.

(b-3) Assigning the value of $Dw_{ALL}$ determined in the above (b-1) and the value of Dw determined in the above (b-2) to the relational formula $Cw=Dw_{ALL}/Dw$ gives Cw.

As in the above, the minimum wax content not worsening HOS can be determined.

Similarly, in the above-mentioned method (I), the toner for development of electrostatic images from which the dust emission Dt satisfies the range of any of the formulae (2) to (4) may be obtained by preparing a toner for development of electrostatic images having a shell/core structure, making the shell contain the wax component Y and making the core contain the wax component X.

In the method (II), wax is added as an external additive to the primary particles of polymer to be mentioned below thereby dispersing the wax component X and the wax component Y in all the toner mother particles before formed into the intended toner for development of electrostatic images. It is necessary that the dust emission of the wax component X and the wax component Y and the content thereof in the toner all satisfy the above-mentioned relationship.

In the toner for development of the present invention, the melting point of the wax in a state of being contained in the toner can be determined according to the method described in the section of <Measurement Method and Definition of Melting Point of Wax in a State of being Contained in Toner for Development of Electrostatic Images> in Examples. In the toner for development of the present invention, the wax has, as in a state of being contained in the toner, at least one melting point falling within a range of from 55° C. to 90° C.

According to the measurement method for the wax melting point, the wax in the toner for development of the present invention obtained according to the above-mentioned methods (I) and (II) preferably has at least one melting point in a range of from 55° C. to lower than 70° C. and at least one melting point in a range of from 70° C. to 80° C.

Further, the toner for development of the present invention can improve hot offset resistance while preventing dust emission during fixation, even in a high-speed machine that consumes a large amount per unit time of toner for development of electrostatic images or even in a case where the amount of toner to adhere to paper for development of electrostatic images thereon in graphic use, and consequently, the toner of the present invention is favorably used in high-speed printing. Above all, the toner of the present invention can especially exhibit the advantageous effects in a high-speed machine in which the printing speed (Vp) is 20 (sheets/min) or more, more preferably the printing speed (Vp) is 30 (sheet/min) or more, and is therefore favorably used in such a high-speed machine.

The method for producing the toner for development of electrostatic images of the present invention is not specifically defined, and it may be only necessary to employ the constitution to be described below in a wet-type toner production method or a ground toner production method.

<Constitution of Toner>

The binder resin to constitute the toner of the present invention may be suitably selected and used from any one known usable as a toner in the art. For example, there are mentioned styrenic resins, vinyl chloride resins, rosin-modified maleic acid resins, phenolic resins, epoxy resins, saturated or unsaturated polyester resins, polyethylenic resins, polypropylenic resins, ionomer resins, polyurethane resins, silicone resins, ketone resins, ethylene-acrylate copolymers, xylene resins, polyvinyl butyral resins, styrene-alkyl acrylate copolymers, styrene-alkyl methacrylate copolymers, styrene-acrylonitrile copolymers, styrene-butadiene copolymers, styrene-maleic anhydride copolymers, etc. One alone or two or more different types of those resins may be used here either singly or as combined.

As the colorant to constitute the toner of the present invention, any one may be suitably selected from those known usable for toner. For example, there are mentioned yellow pigments, magenta pigments and cyan pigments described below. As black pigments, usable here are carbon black and those prepared to be black by blending yellow pigment/magenta pigment/cyan pigment shown below.

Of those, carbon black as a black pigment exists as an aggregate of extremely fine primary particles and, when dispersed as a pigment dispersion, the particles may readily grow into coarse particles through reaggregation. The degree of reaggregation of carbon black particles may have a correlation with the level of the impurity amount (level of the amount of the remaining undecomposed organic substances) contained in carbon black, and when containing a large amount of impurities, the carbon black of the type tends to seriously coarsen owing to the reaggregation after dispersion.

Regarding the quantitative evaluation of the amount of impurities, it is desirable that the UV absorbance of the toluene extract from carbon black, as measured according to the method mentioned below, is 0.05 or less, more preferably 0.03 or less. In general, carbon black according to a channel process tends to contain a large amount of impurities, and as the carbon black for use in the present invention, preferred is one produced according to a furnace process.

The UV absorbance ($\lambda c$) of carbon black is determined according to the method mentioned below.

First, 3 g of carbon black is fully dispersed and mixed in 30 ml of toluene, and then the resulting mixture is filtered through No. 5C filter paper. Subsequently, the filtrate is put into a quartz cell of which the absorption part has a size of 1 cm square, and using a commercially-available UV spectrophotometer, the absorbance ($\lambda s$) thereof at a wavelength of 336 nm is measured. According to the same method, the absorbance ($\lambda o$) of toluene alone is measured for a reference. The UV absorbance of the carbon black is determined as $\lambda c=\lambda s-\lambda o$. As the commercially-available spectrophotometer, for example, usable here are Shimadzu's UV-visible light spectrophotometer (UV-3100PC), etc.

As yellow pigments, usable are compounds of typically condensed azo compounds, iso indolinone compounds, etc. Concretely, preferred is use of C.I. Pigment Yellow 12, 13, 14, 15, 17, 62, 74, 83, 93, 94, 95, 109, 110, 111, 128, 129, 147, 150, 155, 168, 180, 194, etc.

As magenta pigments, usable are condensed azo compounds, diketopyrrolopyrrole compounds, anthraquinone, quinacridone compounds, basic dye lake compounds, naphthol compounds, benzimidazolone compounds, thioindigo compounds, perylene compounds.

Concretely, preferred is use of C.I. Pigment Red 2, 3, 5, 6, 7, 23, 48:2, 48:3, 48:4, 57:1, 81:1, 122, 144, 146, 166, 169, 173, 184, 185, 202, 206, 207, 209, 220, 221, 238, 254, C.I. Pigment Violet 19, etc. Above all, especially preferred are quinacridone pigments of C.I. Pigment Red 122, 202, 207, 209, and C.I. Pigment Violet 19. Of those quinacridone pigments, especially preferred is a compound of C.I. Pigment Red 122.

As cyan pigments, usable are copper phthalocyanine compounds and their derivatives, anthraquinone compounds, basic dye lake compounds, etc. Concretely, especially preferred is use of C.I. Pigment Blue 1, 15, 15:1, 15:2, 15:3, 15:4, 60, 62, 66, etc., and C.I. Pigment Green 7, 36, etc.

<Wet-Method Toner>

The wet-method toner is described.

As a wet method of producing a toner in an aqueous medium, favorably utilized are a radical polymerization method in an aqueous medium, such as a suspension polymerization method, a emulsion polymerization aggregation method or the like (hereinafter this is abbreviated as "polymerization method", and the resultant toner is abbreviated as "polymerization method toner"), and a chemical grinding method, etc. For example, in a conventional production process for a polymerization method toner, the suspension polymerization method includes a method of imparting a high shear force or increasing the dispersion stabilizer or the like in the step of forming polymerizing monomer droplets, etc.

As a method of producing a toner having a particle size falling within a specific range, there may be employed any production method of the above-mentioned polymerization methods of a suspension polymerization method, an emulsion polymerization aggregation method and the like, as well as a chemical grinding method, etc. In the suspension polymerization method and the chemical grinding method, the toner mother particles having a large particle size are processed into those having a small particle size. Accordingly, in order to reduce the mean particle size, the proportion of the particles having a small particle size tends to increase, and therefore a large burden of a classification step or the like would be placed on the method.

As opposed to this, the emulsion polymerization aggregation method may produce particles having a relatively sharp particle size distribution and, according to the method, toner mother particles having a small particle size are processed into those having a large particle size. Therefore, the method gives a toner having a regulated particle size distribution without requiring any classification step, etc. For the above reasons, it is especially preferable that the toner of the present invention is produced according to an emulsion polymerization aggregation method.

A classification step is generally indispensable in the grinding method toner, but for the wet method toner, especially according to an emulsion polymerization aggregation method, a toner having a desired particle size distribution can be produced not requiring classification.

Among the polymerization toner production methods, especially preferred in the present invention is a emulsion polymerization aggregation method of carrying out radical polymerization in an aqueous medium. The toner produced according to the method of the type is described in detail hereinunder.

In case where a toner is produced according to an emulsion polymerization aggregation method, in general, the method includes a polymerization step, a mixing step, an aggregation step, a ripening step, and a washing and drying step. Specifically, in general, a dispersion of a colorant, an electrification control agent, a wax and others is mixed with a dispersion containing polymer primary particles produced through emulsion polymerization, and the primary particles in the dispersion are aggregated to be aggregates of particles, then fine particles and other are adhered thereto and fused, and the resultant particles are optionally washed and dried to give toner mother particles. In case where the toner forms a shell/core structure, a polymer primary particles dispersion to be a shell is added to the core formed through the core aggregation step by polymerization, mixing and aggregation, kept as such, and thereafter processed for forming the shell/core structure in a rounding step, and a washing and drying step.

For the binder resin to constitute the polymer primary particles for use in the emulsion polymerization aggregation method, usable is one or more polymerizing monomers that are polymerizable according to an emulsion polymerization method. As the core material, the shell material or the polymerizing monomer for the toner mother particles not forming a shell/core structure, preferred is use of a polymerizing monomer having a Broensted acid group (hereinafter this may be referred to simply as "acid monomer"), or a polymerizing monomer having a Broensted basic group (hereinafter this may be referred to simply as "basic monomer"), or a polymerizing monomer having neither a Broensted acid group nor a Broensted basic group (hereinafter this may be referred to as "other monomer"), as the starting material of the polymerizing monomer. The polymerizing monomer may be added separately, or multiple types of polymerizing monomers may be previously mixed and may be added all at a time. Further, during the addition of the polymerizing monomer, it is possible to change the polymerizing monomer composition. The polymerizing monomer may be added directly as it is, or may be previously mixed with water, an emulsifier or the like to prepare an emulsion, and the resultant emulsion may be added.

The "acid monomer" includes carboxyl group-having polymerizing monomers such as acrylic acid, methacrylic acid, maleic acid, fumaric acid, cinnamic acid, etc.; sulfonic acid group-having polymerizing monomers such as sulfonated styrene, etc., sulfonamide group-having polymerizing monomer such as vinylbenzenesulfonamide, etc.

The "basic monomer" includes amino group-having aromatic vinyl compounds such as aminostyrene, etc.; nitrogen-containing heterocyclic polymerizing monomers such as vinylpyridine, vinylpyrrolidone, etc.; amino group-having (meth)acrylates such as dimethylaminoethyl acrylate, diethylaminoethyl methacrylate, etc.

One alone or two or more of these acid monomers and basic monomers may be used here either singly or as combined. The monomers may exist as salts accompanied by a counter ion. Above all, preferred is use of acid monomers, and more preferred are acrylic acid and/or methacrylic acid. The total amount of the acid monomer and the basic monomer in 100% by mass of all the polymerizing monomers constituting the binder resin for the polymer primary particles is preferably 0.05% by mass or more, more preferably 0.5% by mass or more, even more preferably 1% by mass or more. The upper limit is preferably 10% by mass or less, more preferably 5% by mass or less.

The "other monomer" includes styrenes such as styrene, methylstyrene, chlorostyrene, dicholorostyrene, p-tert-butylstyrene, p-n-butylstyrene, p-n-nonylstyrene, etc.; acrylates such as methyl acrylate, ethyl acrylate, propyl acrylate, n-butyl acrylate, isobutyl acrylate, hydroxyethyl acrylate, ethylhexyl acrylate, etc.; methacrylates such as methyl methacrylate, ethyl methacrylate, propyl methacrylate, n-butyl methacrylate, isobutyl methacrylate, hydroxyethyl methacrylate, ethylhexyl methacrylate, etc.; N-propylacrylamide, N,N-dimethylacrylamide, N,N-dipropylacrylamide, N,N-dibutylacrylamide, acrylic acid amide, etc. One alone or two or more polymerizing monomers may be used here either singly or as combined.

In the present invention, of the combined use of the above-mentioned polymerizing monomers and others, one preferred embodiment is a combination of an acid monomer and other monomer. More preferably, acrylic acid and/or methacrylic acid is used as the acid monomer, and a polymerizing monomer selected from styrenes, acrylates and methacrylates is used as the other monomer. Even more preferably, acrylic acid and/or methacrylic acid is used as the acid monomer, and a combination of styrene and an acrylate and/or a methacrylate is used as the other monomer. Especially preferably, acrylic acid and/or methacrylic acid is used as the acid monomer, and a combination of styrene and n-butyl acrylate is used as the other monomer.

In case where a crosslinked resin is used as the binder resin to constitute the polymer primary particles, a radical-polymerizing polyfunctional monomer is used as the crosslinking agent to be used along with the above-mentioned polymerizing monomer, including, for example, divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate, diallyl phthalate, etc. Also usable is a polymerizing monomer having a reactive group in the pendant group, for example, glycidyl methacrylate, methylolacrylamide, acrolein, etc. Above all, preferred is a radical-polymerizing difunctional monomer, and especially preferred are divinylbenzene and hexanediol diacrylate.

One alone or two or more different types of these polyfunctional monomers may be used here either singly or as combined. In case where a crosslinked resin is used as the binder resin to constitute the polymer primary particles, the proportion of the polyfunctional monomer in all the polymerizing monomers constituting the resin is preferably 0.005% by mass or more, more preferably 0.1% by mass or more, even more preferably 0.3% by mass or more. The upper limit is preferably 5% by mass or less, more preferably 3% by mass or less, even more preferably 1% by mass or less.

Any known emulsifier is usable for emulsion polymerization. One or more emulsifiers selected from cationic surfactants, anionic surfactants and nonionic surfactants are usable either singly or as combined.

The cationic surfactants include, for example, dodecylammonium chloride, dodecylammonium bromide, dodecyltrimethylammonium bromide, dodecylpyridinium chloride, dodecylpyridinium bromide, hexadecyltrimethylammonium bromide, etc.

The anionic surfactants include, for example, fatty acid soaps such as sodium stearate, potassium dodecanoate, etc., sodium dodecylsulfate, sodium dodecylbenzenesulfonate, sodium laurylsulfate, etc.

The nonionic surfactants include, for example, polyoxyethylene dodecyl ether, polyoxyethylene hexadecyl ether, polyoxyethylene nonylphenyl ether, polyoxyethylene lauryl ether, polyoxyethylene sorbitan monooleate ether, monodecanoylsucrose, etc.

The amount of the emulsifier to be used is generally from 1 to 10 parts by mass relative to 100 parts by mass of the polymerizing monomer. Along with the emulsifier, also usable here are one or more of polyvinyl alcohols such as partially or completely saponified polyvinyl alcohol, etc., cellulose derivatives such as hydroxyethyl cellulose and others, as a protective colloid.

As the polymerization initiator, for example, usable are hydrogen peroxide; persulfates such as potassium persulfate, etc.; organic peroxides such as benzoyl peroxide, lauroyl peroxide, etc.; azo compounds such as 2,2'-azobisisobutyronitrile, 2,2'-azobis(2,4-dimethylvaleronitrile), etc.; redox initiators, etc. One or more of these may be used generally in an amount of from 0.1 to 3 parts by mass relative to 100 parts by mass of the polymerizing monomer. Above all, all or a part of the initiator is preferably hydrogen peroxide or an organic peroxide.

One or more suspension stabilizers of calcium phosphate, magnesium phosphate, calcium hydroxide, magnesium hydroxide and the like may be used in an amount of generally from 1 to 10 parts by mass relative to 100 parts by mass of the polymerizing monomer.

The polymerization initiator and the suspension stabilizer may be added to the polymerization system in any stage before addition of the polymerizing monomer, along with addition thereof, or after addition thereof, and if desired, the addition modes may be combined.

In emulsion polymerization, if desired, any known chain transfer agent is usable here. Specific examples of the chain transfer agent include t-dodecylmercaptan, 2-mercaptoethanol, diisopropyl xanthogenate, carbon tetrachloride, trichlorobromomethane, etc. One alone or two or more chain transfer agents may be used here either singly or as combined, and the amount thereof may be generally 5% by mass relative to all the polymerizing monomers. In addition, a pH regulator, a polymerization degree regulator, a defoaming agent and the like may be suitably added to the reaction system.

For emulsion polymerization, the above-mentioned polymerizing monomers and others are polymerized in the presence of the polymerization initiator, and the polymerization temperature is generally from 50 to 120° C., preferably from 60 to 100° C., more preferably from 70 to 90° C.

The volume-average diameter (Mv) of the polymer primary particles obtained through emulsion polymerization is generally 0.02 μm or more, preferably 0.05 μm or more, more preferably 0.1 μm or more, and is generally 3 μm or less, preferably 2 μm or less, more preferably 1 μm or less. When the volume-average diameter (Mv) of the polymer primary particles falls within the above range, then the aggregation speed is relatively easy to control and a toner having an intended particle size can be thereby obtained.

The glass transition temperature (Tg), as measured according to a DSC method, of the binder resin to constitute the polymer primary particles is preferably from 40 to 80° C. Here, in case where Tg of the binder resin overlaps with the heat quantity change based on the other components, for example, with the melting peak of polylactone or wax, and therefore could not be clearly determined, Tg here means the value in the case where the toner is prepared after these other components are removed.

The acid value of the binder resin that constitutes the polymer primary particles, as measured according to the method of JISK-0070 (1992), is preferably from 3 to 50 mg KOH/g, more preferably from 5 to 30 mg KOH/g.

The colorant may be any one generally used in the art, and is not specifically defined. For example, usable are the above-mentioned pigments, carbon black such as furnace black, lamp black, etc.; magnetic colorants, etc. The content of the colorant may be such that the resultant toner could form a visible image through development, and for example, the colorant may be in an amount of from 1 to 25 parts by mass in the toner, preferably from 1 to 15 parts by mass, more preferably from 3 to 12 parts by mass.

The colorant may be magnetic, and the magnetic colorant includes substances that are ferromagnetic or ferromagnetic or strongly magnetic at the operation environment temperature for printers, copiers and others, or at from 0 to 60° C. or so. Concretely, for example, there are mentioned magnetite ($Fe_3O_4$), maghematite ($\gamma$-$Fe_2O_3$), intermediates or mixtures of magnetite and maghematite, spinel ferrites represented by $M_xFe_{3-x}O_4$ (M means Mg, Mn, Fe, Co, Ni, Cu, Zn, Cd, etc.), hexagonal crystal ferrites such as $BaO.6Fe_2O_3$, $Sro.6Fe_2O_3$, etc., garnet-type oxides such as $Y_3Fe_5O_{12}$, $Sm_3Fe_5O_{12}$, etc., rutile-type oxides such as $CrO_2$, etc.; and those of metals such as Cr, Mn, Fe, Co, Ni or the like and strongly-magnetic alloys thereof that are magnetic at from 0 to 60° C. or so. Above all, preferred are magnetite, maghematite or intermediates of magnetite and maghematite.

From the viewpoint that the toner could be a nonmagnetic toner and that the toner could satisfy anti-scattering and electrification control performance, the content of the magnetic powder in the toner is may be from 0.2 to 10% by mass, preferably from 0.5 to 8% by mass, more preferably from 1 to 5% by mass. On the other hand, in case where the toner is used as a magnetic toner, the content of the magnetic powder in the toner is generally 15% by mass or more, preferably 20% by mass or more, and is generally 70% by mass or less, preferably 60% by mass or less. When the content of the magnetic powder is less than the range, then the magnetic toner could not have a necessary magnetic powder, but when more than the range, it may cause fixation failure.

Regarding the colorant incorporation method in the emulsion polymerization aggregation method, in general, a colorant dispersion is mixed with a dispersion of polymer primary particles to prepare a mixed dispersion, and this may be aggregated to give aggregates of particles. Preferably, the colorant is used in the form of an emulsion thereof as emulsified in water in the presence of an emulsifier by a mechanical means with a sand mill, a bead mill, etc. In preparing the colorant dispersion, it is desirable that the colorant is added in an amount of from 10 to 30 parts by mass and the emulsifier is in an amount of from 1 to 15 parts by mass relative to 100 parts by mass of water. It is desirable that, during the dispersion process, the particle size of the colorant in the dispersion is monitored so that the volume-average diameter (Mv) of the colorant is controlled to be finally from 0.01 to 3 μm, more preferably from 0.05 to 0.5 μm. The number-average diameter (Mn) is preferably from 0.01 to 3 μm, more preferably from 0.05 to 0.5 μm. The proportion of the colorant dispersion to be added during the emulsion aggregation is so controlled that the colorant could be from 2 to 10% by mass in the finished toner mother particles.

Preferably, the wax contained in the toner for development of the present invention includes two types of waxes and the structure thereof is precisely controlled. Specifically, it is desirable that the toner for development of the present invention satisfies the following requirements (a) to (c):

(a) The toner for development contains at least two types of waxes of a wax component X and a wax component Y.

(b) The dust emission from the wax component Y is larger than the dust emission from the wax component X.

(c) The content of the wax component X is larger than the content of the wax component Y.

Here the wax component X and the wax component Y mean two types of waxes that the toner for development contains, and are the same as "wax X" and "wax Y", respectively.

Above all, it is desirable that the content of the wax component X is larger than the content of the wax component Y.

Also preferably, the proportion of the wax component Y to all the wax components is from 0.1% by mass to less than 10% by mass.

Preferably, the toner of the present invention satisfies the following requirement (f) in addition to the above requirements (a) to (c) or in place of the above requirement (c).

(f) The toner for development of electrostatic images has a region in which the abundance ratio of the wax component Y is larger than that of the wax component X, and the region exists more in the outer region of the toner for development of electrostatic images than in the center region thereof.

Specifically, in the case where a wax having a small dust emission is used in the center region of the toner for development and where a wax having a large dust emission is in the outer region of the toner, the hot offset resistance is bettered than in the case where the two waxes are nearly uniformly dispersed in the toner.

This is because wax is added to the toner for development for the purpose of imparting releasability to the toner from a fixation roller, and accordingly, in the case where a highly-sublimable wax capable of imparting high releasability is selectively concentrated in the outer region of the toner for development, the wax can more rapidly diffuse from the toner for development during fixation and therefore can impart higher releasability to the toner.

In this description, in the case where the toner mother particles have a shell/core structure, the outer region of the toner means the shell layer and the center region of the toner means the core layer. However, in fact, the shell part and the core part could not be definitely differentiated, and multiple shell parts and core parts may randomly exist in one toner mother particle. In such a case, the above mentioned requirement (f) "the toner for development has a region in which the abundance ratio of the wax component Y is larger than that of the wax component X, and the region exists more in the outer region of the toner for development of electrostatic images than in the center region thereof" is defined as follows:

Specifically, a condition where all the core components existing inside the toner mother particle are coated with the shell component in a ratio of 50% or more of the circumference thereof is the condition of the above (f).

Concrete examples of the condition of (f) are shown in FIG. 10.

In FIG. 10, the white part is the core component, the white dot line is the circumference of the core component, the gray part is the shell component, and the black solid line is the circumference of the shell part. The condition of (f) is not limited to these.

The abundance ratio of the wax component X and the wax component Y is determined depending on the ratio of the waxes used in production. Accordingly, in order that a highly-sublimable wax having high releasability is selectively concentrated in the outer region of the toner for development, it is only necessary to arrange the highly-sublimable wax more in the shell component than in the core component.

For this, for example, the following methods are employable.

1. The shell component comprises smaller particles than those in the core component.

2. The shell component is added later than the core component.

3. In the case where the toner is produced in a solvent containing water, a component having a higher polarity is used for the shell component than for the core component.

In the above 3, the component having a higher polarity is, for example, a component having a carboxyl group, a sulfonic acid group, a hydroxyl group, an amino group, an alkoxy group or the like.

Any one or two or more of the above-mentioned methods 1 to 3 may be employed here either singly or as combined.

Preferably, the toner for development of electrostatic images of the present invention forms a shell/core structure that has a core where the abundance ratio of the wax having a small dust emission is high in the center region of the toner and a shell where the abundance ratio of the wax having a large dust emission is high in the outer region of the toner. In the present invention, it is more desirable that, in the case where the toner forms a shell/core structure, the wax contained in the shell part of the shell/core structure contains substantially the wax component Y alone and the wax contained in the core part of the shell/core structure contains substantially the wax component X alone. Even in a case where the toner does not form a shell/core structure, it is only necessary that the toner has a region in which the abundance ratio of the wax having a large dust emission is higher in the outer region of the toner than in the center region of the toner.

Containing substantially the wax component Y (or X) alone means that the part may contain any other minor inevitable impurities in addition to the wax component. Here the inevitable impurities mean any other waxes than the wax component Y (or X).

Preferably, the dust emission (Dw) from the wax component X is 50,000 CPM or less, and the dust emission (Dw) from the wax component Y is 100,000 CPM or more. This is because, when the dust emission (Dw) from the wax component X that exists in the center region of the toner is controlled to be 50,000 CPM or less, then the dust amount to be emitted per hour from an image forming device (dust emission rate: Vd) can be controlled to be a lower value, and further when the dust emission (Dw) from the wax component Y that exists in the outer region of the toner is controlled to be 100,000 CPM or more, then the toner can have better hot offset resistance.

The dust emission Dw from the wax component X or the wax component Y can be measured according to the method described in the section of Examples, like the toner dust emission. Here, the static environment means the condition described in the section of Examples, and the heating condition is as described the section of Examples.

Concretely, the wax component X having a small dust emission includes hydrocarbon wax and ester wax, and above all, from the viewpoint of preventing emission, preferred is use of a microcrystalline wax or an ester wax having a large sublimation energy.

The wax component Y having a large dust emission includes hydrocarbon wax, and above all, from the viewpoint of the ability to impart releasability, preferred is use of a paraffin wax containing many linear molecules.

Preferably, the toner for development of the present invention has a shell/core structure and uses wax-including polymer primary particles having a volume-average diameter (Mv) of from 50 nm to 500 nm as at least one shell part.

The production method for the toner for development having a shell/core structure of the present invention is not specifically defined. Shell fine particles produced according to an emulsion polymerization method, a miniemulsion method or a coacervation method are adhered to the surfaces of core particles produced according to any of a grinding method, an emulsion polymerization aggregation method, a suspension polymerization method or a chemical grinding method (melt suspension method), and subsequently, if desired, the shell and the core are fused by heating to provide the intended shell/core structured toner.

The reason why the shell/core structure is employed is because arranging wax in the more outer region from the viewpoint of releasability but, on the other hand, existence of wax on the outermost surface of the toner for development is often disadvantageous in that some members such as a photoreceptor and others may be stained and satisfactory images could not be obtained.

As the means for attaining the object, preferred is use of polymer primary particles that include wax having the above-mentioned volume-average diameter (Mv) by the use of a resin component and according to an emulsion polymerization method, a miniemulsion method or a coacervation method, as one of the shell part. For example, for obtaining the polymer primary particles as the shell part according to an emulsion polymerization method, employable is the same process as that for producing the polymer primary particles to give the toner according to the emulsion polymerization aggregation method.

The wax for use herein must indispensably contain a wax having a melting point not higher than 90° C., for imparting satisfactory fixation ability to the toner for development of electrostatic images. This is because a wax having a too high melting point could difficultly diffuse out from the toner having molten in a fixing unit, even though the sublimation energy thereof is low, and as a result, could not move to the toner surface therefore failing in imparting sufficient releasability.

Further, a wax having a too low melting point would lower the heat resistance of the toner and may additionally provide a problem of blocking during transportation, and therefore the wax of the type could not be used. Consequently, the toner indispensably contains a wax having a melting point not lower than 55° C.

The melting point of the wax itself is from 55° C. to 90° C. The melting point of the wax that is in a state of being contained in the toner for development of electrostatic images is a value measured according to the method described in the section of Examples given hereinunder. Using a thermal analyzer (DSC), the toner is analyzed in the condition where the peak (heat history) derived from the enthalpy relaxation at the glass transition point of the resin in the toner has disappeared.

Further, the wax to be used for producing the toner for development of electrostatic images in such a manner that the value of the dust emission Dt (CPM) from the toner can satisfy any of the formulae (1) to (4) defined in this description is not specifically defined except the melting point thereof mentioned above. Concretely, examples of the wax include olefin waxes; paraffin waxes; ester waxes having a long-chain aliphatic group such as behenyl behenate, montanates, stearyl stearate, etc.; vegetable waxes such as hydrogenated castor oil, carnauba wax, etc.; ketones having a long-chain alkyl group such as distearyl ketone, etc.; silicones having an alkyl group; higher fatty acids such as stearic acid, etc.; long-chain aliphatic alcohols such as eicosanol, etc.; polyalcohol carboxylates obtained from a polyalcohol such as glycerin, pentaerythritol or the like and a long-chain fatty acid, or partial esters thereof; higher fatty acid amides such as oleic acid amide, stearic acid amide, etc.; low-molecular-weight polyesters, etc.

Above all, preferred are hydrocarbon waxes (Fischer-Tropsch wax, microcrystalline wax, polyethylene wax, polypropylene wax), and ester waxes (esters of long-chain fatty acid and long-chain alcohol, esters of long-chain fatty acid and polyalcohol).

The amount of wax to be used is not specifically defined in any case where the toner forms a shell/core structure or where the toner does not form a shell/core structure and the binder resin, the colorant and the wax are nearly uniformly includes therein. It may be only necessary to produce the toner for development of electrostatic images, using the wax of which the melting point falls within the above-mentioned range in such a manner that the dust emission Dt (CPM) from the toner can satisfy any of the formulae (1) to (4) defined in this description, and any other specific limitation is unnecessary for the toner production.

Above all, any of the core part, the shell part and the toner mother material not forming a shell/core structure may contain the wax preferably in an amount of from 4 to 30 parts by mass, more preferably from 5 to 20 parts by mass, even more preferably from 7 to 15 parts by mass relative to 100 parts by mass of the binder resin. When the amount of the wax is smaller than the range, then the toner could hardly has satisfactory hot offset resistance owing to releasability insufficiency; but when larger than the range, then the toner could hardly prevent dust emission.

However, when the toner for development of electrostatic images is produced using the wax of which the melting point falls within the range defined in this description and in such a manner that the dust emission Dt (CPM) from the toner could satisfy the requirement as defined herein, then the amount of wax to be used is not specifically defined at all.

In case where the toner contains two types of waxes of the wax component X and the wax component Y and when the two waxes are so selected that the dust emission from the wax component Y is larger than the dust emission from the wax component X, then any of the waxes exemplified hereinabove can be used in any desired manner.

Regarding the wax addition mode in the emulsion polymerization aggregation method, it is desirable that a wax dispersion previously prepared by emulsifying and dispersing a wax in water to have a volume-average diameter (Mv) of from 0.01 to 2.0 μm, more preferably from 0.01 to 1.0 μm, even more preferably from 0.01 to 0.5 μm is added during emulsion polymerization or added in the aggregation step.

For dispersing a wax in a toner to have a suitable dispersion particle size, it is desirable that the wax is added as a seed during emulsion polymerization. Adding as a seed provides polymer primary particles including the wax therein, and therefore a large amount of wax does not exist on the toner surface and the chargeability and the heat resistance of the toner could be prevented from worsening. The amount of the wax to be added is so controlled that the amount thereof existing in the polymer primary particles could be preferably from 4 to 30% by mass, more preferably from 5 to 20% by mass, even more preferably from 7 to 15% by mass.

An electrification control agent may be added to the toner of the present invention for controlling the chargeability of the toner and for imparting charging stability to the toner. As the electrification control agent, any known compounds are usable here. For example, there are mentioned metal complexes of hydroxycarboxylic acids, metal complexes of azo compounds, naphtholic compounds, metal compounds of naphtholic compounds, nigrosine dyes, quaternary ammonium salts and their mixtures. The amount of the electrification control agent to be added is preferably within a range of from 0.1 to 5 parts by mass relative to 100 parts by mass of resin.

In case where an electrification control agent is added to the toner in an emulsification polymerization aggregation method, there may be employed a method of adding the electrification control agent along with a polymerizing monomer and others during emulsion polymerization, a method of adding it along with polymer primary particles and a colorant in the aggregation step, or a method of adding it after polymer primary particles and a colorant have been aggregated to give a toner almost having a suitable particle size. Of those, preferred is a method where an electrification control agent is emulsified and dispersed in water using an emulsifier to give an emulsion having a volume-average diameter (Mv) of from 0.01 μm to 3 μm. Preferably, the electrification control agent dispersion is incorporated during emulsion aggregation in such a controlled manner that the amount of the electrification control agent could be from 0.1 to 5% by mass in the finished toner mother particles.

The volume-average diameter (Mv) of the polymer primary particles, the colorant dispersion particles, the wax dispersion particles, the electrification control agent dispersion particles and others in the above-mentioned dispersion is measured according to the method described in the section of Examples using Nanotrac, and the measured value is defined as the volume-average diameter.

In the aggregation step in the emulsion polymerization aggregation method, the above-mentioned constituent ingredients of polymer primary particles, colorant particles, and optionally electrification control agent, wax and others are mixed simultaneously or successively; however, it is desirable that dispersions of the individual ingredients, or that is, a polymer primary particles dispersion, a colorant particles dispersion, an electrification control agent dispersion and a wax fine particles dispersion are previously prepared and these are mixed to give a mixed dispersion, from the viewpoint of the composition uniformity and the particle size uniformity.

For the aggregation treatment, in general, employable is a method of heating or a method of adding an electrolyte in a stirring tank, or a combined method of these. In case where the primary particles are aggregated with stirring to give aggregates of particle having a nearly the same size as that of toner, the particle size of the aggregated particles may be controlled by the balance between the cohesion force of the particles and the shear force by stirring; however, by heating or by adding an electrolyte, the cohesion force can be enlarged.

The electrolyte to be added for aggregation may be any of organic salts or inorganic salts, concretely including NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$, $C_6H_5SO_3Na$, etc. Of those, preferred are inorganic salts having a divalent or more polyvalent metal cation.

The amount of the electrolyte to be added varies depending on the type of the electrolyte and the intended particle size. In general, the amount is from 0.05 to 25 parts by mass relative to 100 parts by mass of the solid component in the mixed dispersion, preferably from 0.1 to 15 parts by mass, more preferably from 0.1 to 10 parts by mass. When the added amount is less than the range, then the aggregation reaction would go on slowly, and therefore even after aggregation reaction, fine powder of 1 μm or less in size may remain, or the mean particle size of the resultant aggregated particles could not reach the intended level. On the other hand, when the amount is more than the range, then aggregation would go on too rapidly and it would be difficult to control the particle size and there may occur another problem that coarse particles and amorphous particles may exist in the resultant aggregated particles.

Here, as the method of controlling the particle size to fall within the specific range in the present invention, there may be employed a method of reducing the amount of the electrolyte to be added. In general, reducing the amount of the electrolyte to be added may lower the particles growing speed and is therefore industrially unfavorable from the viewpoint of the production efficiency. However, contrary to the industrial viewpoint, the particle size could be controlled to fall within the specific range in the present invention by daringly reducing the amount of the electrolyte to be added.

The aggregation temperature at which the aggregation is carried out along with electrolyte addition is preferably from 20 to 70° C., more preferably from 30 to 60° C. Here, controlling the temperature before the aggregation step is also one method of controlling the particle size to fall within the specific range. Of the colorants to be added to the aggregation step, some may have the property of electrolyte, and therefore without electrolyte addition, the aggregation may occur in such a case. Consequently, by previously cooling the polymer primary particles dispersion before mixing with the colorant dispersion, the aggregation could be prevented. The aggregation may be a cause of fine powder generation and may be a cause of particle size distribution unevenness. In the present invention, it is desirable that the polymer primary particles are previously cooled to a temperature range of preferably from 0 to 15° C., more preferably from 0 to 12° C., even more preferably from 2 to 10° C.

The aggregation temperature in the case where the aggregation is attained only by heating without using an electrolyte is generally within a temperature range of from (Tg-20° C.) to Tg relative to the glass transition temperature Tg of the polymer primary particles, and is preferably from (Tg-10° C.) to (Tg-5° C.).

The time to be taken for aggregation could be optimized depending on the device configuration and the process scale. In order to make the particle size of the toner mother particles reach the intended particle size, it is desirable to keep the system at the temperature falling within the range generally at least 30 minutes or more. Regarding the heating mode up to the desired temperature, the system may be heated at a constant rate, or may be heated at a stepwise increasing heating rate.

In the present invention, if desired, a polymer primary particles dispersion may be added to (adhered to or caked on) the aggregated particles after the aggregation treatment, thereby producing toner mother particles having a shell/core structure.

The shell part preferably contains wax-containing or including polymer primary particles having a volume-average diameter (Mv) of preferably from 50 nm to 500 nm, more preferably from 80 nm to 450 nm, even more preferably from 100 nm to 400 nm, still more preferably from 150 nm to 350 nm.

When the volume-average diameter (Mv) of the wax-including polymer primary particles to be the shell falls within the above range, then the shell may be efficiently adhered to the core, and therefore in case where a region in which the abundance ratio of the wax having a large dust emission is formed in the outer region of the toner, a higher releasability can be given to the resultant toner and, as a result, the dust amount to be emitted from an image forming device per hour (dust emission rate: Vd) can be readily controlled to a lower value and the toner can have better hot offset resistance.

From the above, the embodiment where the toner for development of electrostatic images has a shell/core structure, where the core part of the shell/core structure contains polymer primary particles substantially containing or including the above-mentioned wax component X alone and having a volume-average diameter (Mv) of from 50 nm to 500 nm, and where the shell part of the shell/core structure contains polymer primary particles substantially containing or including the above-mentioned wax component Y alone and having a volume-average diameter (Mv) of from 50 nm to 500 nm is a preferred embodiment of the toner for development of electrostatic images of the present invention.

Resin fine particles are generally used in the form of a dispersion thereof prepared by dispersing the particles in water or a water-based liquid along with an emulsifier. In case where the electrification control agent is added after the aggregation treatment, it is desirable that the resin fine particles are added after the electrification control agent is added to the aggregated particles-containing dispersion.

In the emulsion polymerization aggregation method, for the purpose of increasing the stability of the aggregated particles formed through aggregation, it is desirable that an emulsifier or a pH regulator is added as a dispersion stabilizer to thereby lower the cohesion force of the particles, and after the growth of the toner mother particles is thus stopped, a ripening step of causing fusion of the aggregated particles is carried out in the method.

Here, it is desirable that the toner of the present invention has a sharp particle size distribution. As a method of controlling the particle size to fall within a specific range, employable here is a step of lowering the stirring rotation number, or that is, lowering the shear force by stirring, prior to the step of adding the emulsifier or the pH regulator.

In the ripening step, the viscosity of the binder resin is lowered by heating for rounding the particles. However, when the system is heated directly as it is, then the growth of the toner mother particles could not be stopped, and therefore, for the purpose of stopping the growth of the particles by heating, in general, an emulsifier or a pH regulator may be added as a dispersion stabilizer, or the stirring rotation number may be increased so as to impart shear force to the system/

Not prior to the dispersion stabilizer addition step, the stirring rotation number may be lowered to reduce the shear force to be given to the aggregated particles, whereby the toner having a specific particle size distribution can also be produced. However, in consideration of the point of controlling the blending amount of the dispersion stabilizer, it is desirable that the control treatment is carried out before the dispersion stabilizer addition step.

The temperature in the ripening step is preferably not lower than Tg of the binder resin to constitute the primary particles, more preferably a temperature higher by 5° C. than Tg, and is preferably not higher than a temperature higher by 80° C. than Tg, more preferably not higher than a temperature higher by 50° C. than Tg. The time to be taken by the ripening step varies depending on the shape of the intended toner. It is desirable that, after having reached a temperature not lower than the glass transition temperature of the polymer constituting the primary particles, the particles are kept as such generally for from 0.1 to 10 hours, preferably from 1 to 6 hours.

In the emulsion polymerization aggregation method, it is desirable that, in the step after the aggregation step, preferably before the ripening step or during the ripening step, an emulsifier is added or the pH value of the aggregation liquid is increased. As the emulsifier to be used here, one or more may be selected from the emulsifiers for use in production of the above-mentioned polymer primary particles. Preferably, the emulsifier to be used here is the same as that used in production of the polymer primary particles.

The amount of the emulsifier to be added is not specifically defined. Preferably, the amount is 0.1 parts by mass or more relative to 100 parts by mass of the solid ingredient in the mixed dispersion, more preferably 1 part by mass or more, even more preferably 3 parts by mass or more, and is preferably 20 parts by mass or less, more preferably 15 parts by mass or less, even more preferably 10 parts by mass or less. By adding an emulsifier or by elevating the pH value of the aggregation liquid after the aggregation step and before the completion of the ripening step, the aggregated particles that have been aggregated during the aggregation step can be prevented from being further aggregated together, and therefore any coarse particles can be prevented from forming in the toner after the ripening step.

Through the heat treatment, the primary particles of the aggregates are fused and integrated together so that the aggregates could have nearly a spherical form of toner mother particles. The aggregated particles before the ripening step are considered to be electrostatic or physical aggregates of primary particles, but after the ripening step, the polymer primary particles constituting the aggregated particles are fused together so that the resultant toner mother particles could be nearly spherical. Through the ripening step in which the temperature and the time are controlled, there can be produced toner having various shapes in accordance with the intended object thereof, including grape bunch-like aggregates of primary particles, potato-like fused aggregates thereof, spherical further-fused aggregates thereof, etc.

The aggregated particles produced through the above-mentioned steps may be processed for solid/liquid separation according to a known method to collect the aggregated particles, and then these are optionally washed and dried to give the intended toner mother particles.

In addition, an outer layer of mainly a polymer may be further formed, having a thickness of preferably from 0.01 to 0.5 μm, on the surfaces of the particles obtained through the above-mentioned emulsion polymerization aggregation method, for example, according to a spray-dry method, an in-situ method, a submerged particle coating method or the like, thereby providing encapsulated toner mother particles.

The toner produced according to the emulsion polymerization aggregation method is preferably such that the 50% circularity thereof, as measured with a flow particle image analyzer, FPIA-3000 (by Malvern), is 0.90 or more, more preferably 0.92 or more, even more preferably 0.95 or more. In particles that are more spherical, the charging amount would hardly be localized therein and the particles could provide uniform development. However, it is difficult to produce completely spherical toner in view of the production thereof, and therefore, the above-mentioned mean circularity is preferably 0.995 or less, more preferably 0.990 or less.

Preferably, at least one peak molecular weight in gel permeation chromatography (hereinafter this may be abbreviated as "GPC") of the tetrahydrofuran (THF) soluble fraction of the toner is 10,000 or more, more preferably 15,000 or more, even more preferably 20,000 or more, and is preferably 100,000 or less, more preferably 80,000 or less, even more preferably 50,000 or less. When every peak molecular weight is lower than the above range, the mechanical durability of the toner in a nonmagnetic one-pack development system would be poor, and when every peak molecular weight is higher than the above range, the low-temperature fixation performance and the fixation intensity with the toner may worsen.

The THF soluble fraction of the toner is, as measured according to a mass method through Celite filtration, preferably 1% by mass or more, more preferably 2% by mass or more, and is preferably 20% by mass or less, more preferably 10% by mass or less. When falling out of the above range, it would be difficult to satisfy both mechanical durability and low-temperature fixation performance.

Regarding the charging property of the toner produced according to the emulsion polymerization aggregation method may be either positive or negative. The charging property of the toner may be controlled by selecting the type and the amount of the electrification control agent, and the type and the amount of external additives, etc.

<Grinding Method Toner>

Regarding the method of producing the toner of the present invention through grinding, the production method is not specifically defined so far as the produced toner satisfy the dust emission (CPM) defined in the present application. For example, there is mentioned a production method described below.

The resin to be used in producing a ground toner may be suitably selected from any one known usable for toner. For example, usable are styrenic resins, vinyl chloride resin, rosin-modified maleic acid resins, phenolic resins, epoxy resins, saturated or unsaturated polyester resins, ionomer resins, polyurethane resins, silicone resins, ketone resins, ethylene-acrylate copolymers, xylene resins, polyvinyl butyral resins, etc. One alone or two or more of these resins may be used here either singly or as combined.

The polyester resin for use in producing the ground toner may be prepared by polymerizing a polymerizing monomer composition that comprises a polyalcohol and a polybasic acid, in which, if desired, at least one of the polyalcohol and the polybasic acid contains a tri- or more polyfunctional component (crosslinking component). In the above, the dialcohol for use in synthesis of the polyester resin includes, for example, diols such as ethylene glycol, diethylene glycol, diethylene glycol, 1,2-propylene glycol, 1,3-propylene glycol, 1,4-butanediol, neopentyl glycol, 1,4-butenediol, 1,5-pentanediol, 1,6-hexanediol, etc.; bisphenol A, hydrogenated bisphenol A; bisphenol A alkylene oxide adducts such as polyoxyethylene bisphenol A, polyoxypropylene bisphenol A, etc., and others. Of those monomers, especially preferred is use of a bisphenol A alkylene oxide adduct as the main ingredient monomer. Above all, especially preferred are adducts in which the mean addition number of alkylene oxide per molecule is from 2 to 7.

The tri- or more polyalcohol participating in crosslinking of polyester includes, for example, sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and others.

On the other hand, the polybasic acid includes, for example, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, anhydrides and lower alkyl esters of these acids; alkenylsuccinic acids or alkylsuccinic acids such as n-dodecenylsuccinic acid, n-dodecylsuccinic acid, etc.; and other dicarboxylic organic acids.

The tri- or more polybasic acid that participates in crosslinking of polyester includes, for example, 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and their anhydrides, and others.

These polyester resins can be produced according to an ordinary method. Concretely, the conditions such as the reaction temperature (170 to 250° C.), the reaction pressure (5 mmHg to normal pressure) and others are defined depending on the reactivity of the monomer, and at the time when the predetermined physical properties can be obtained, the reaction may be finished. The softening point (Sp) of the polyester resin is preferably from 90 to 135° C., more preferably from 95 to 133° C. The range of Tg is, for example, when the softening point is 90° C., from 50 to 65° C., and is from 60 to 75° C. when the softening point is 135° C. In this case, when Sp is lower than the above range, then there may often occur an offset phenomenon during fixation; but when higher than the range, the fixation energy increases and the glossiness and the transparency of color toner may worsen, and anyhow, the case is unfavorable. On the other hand, when Tg is lower than the range, the toner may readily form aggregation blocks and may often cake; but when higher than the range, the fixation intensity during thermal fixation may lower, and anyhow, the case is unfavorable.

Sp may be controlled mainly by the molecular weight of the resin. The number-average molecular weight of the tetrahydrofuran soluble fraction of the resin, as measured through GPC, is preferably from 2000 to 20000, more preferably from 3000 to 12000. Tg may be controlled by selecting the monomer component mainly constituting the resin. Concretely, Tg may be increased by selecting an aromatic polybasic acid as the main component of the acid ingredient. Specifically, of the above-mentioned polybasic acids, preferred is use of phthalic acid, isophthalic acid, terephthalic acid, 1,2,4-benzenetricarboxylic acid, 1,2,5-benzenetricarboxylic acid and their anhydrides or lower alkyl esters, as the main component.

Sp is defined to be the value measured using the flow tester described in JIS K7210 (1999) and K6719 (1999). Concretely, using a flow tester (CFT-500, by Shimadzu), about 1 g of a sample is, while preheated at 50° C. for 5 minutes at a heating speed of 3° C./min, given a load of 30 kg/cm$^2$ through a plunger having an area of 1 cm$^2$, and is thus extruded out through a die having a pore diameter of 1 mm and a length of 10 mm. Accordingly, the plunger stroke-temperature profile curve is drawn, and the height of the S-shaped curve is referred to as h. The temperature corresponding to h/2 is defined as the softening point of the sample. Tg is defined as the value measured according to an ordinary method using a differential scanning calorimeter (Perkin Elmer's DSC7 or Seiko Electronics' DSC 120).

In general, when the acid value of the polyester resin is too high, it is difficult to secure a stable high charging amount, and the charging stability in high-temperature high-humidity environments may worsen. Consequently, in the present invention, the resin is prepared in such a controlled manner that the acid value thereof could be preferably 50 mg KOH/g or less, more preferably 30 mg KOH/g or less, most preferably from 3 to 15 mg KOH/g. As the method for controlling the acid value to fall within the above range, herein employable are a method of controlling the blending proportion of the alcoholic monomer and the acidic monomer to be used in resin production, as well as, for example, a method of using an acid monomer component that has been previously esterified with a lower alkyl through inter-esterification, a method of incorporating a basic component such as an amino group-containing glycol or the like in the composition to thereby neutralize the remaining acid group, etc. However, not limited to these, it is needless to say that any other known method is employable here. The acid value of the polyester resin is measured according to the method of JIS K0070 (1992). However, in case where the resin is hardly soluble in the solvent, a good solvent such as dioxane or the like is used.

Preferably, the physical properties of the polyester resin fall within the range surrounded by the lines represented by the following formula (i) to (iv), for which the glass transition temperature (Tg) and the softening point (Sp) of the resin are plotted on the xy coordinates in which the former is a valuable number of on the x-axis and the latter is a valuable number on the y-axis. The unit of Tg and Sp is ° C.

$$Sp=4\times Tg-110 \quad \text{Formula (i)}$$

$$Sp=4\times Tg-170 \quad \text{Formula (ii)}$$

$$Sp=90 \quad \text{Formula (iii)}$$

$$Sp=135 \quad \text{Formula (iv)}$$

In case where the polyester resin having the physical properties surrounded by the lines represented by the above-mentioned formulae (i) to (iv) is used in a ground toner, then the grinding method toner could be extremely highly resistant to mechanical stress and, in addition, in continuous use thereof, the toner could be prevented from being aggregated or solidified by the generated friction heat and therefore could maintain suitable chargeability for a long period of time.

Also in the ground toner, any ordinary colorant is usable without any specific limitation thereon. For example, the above-mentioned colorants for use in the polymerization toner are also usable. The content of the colorant may be an amount that is enough for the resultant toner to form visible images, and for example, the content is preferably within a range of from 1 to 25 parts by mass in the same level of toner as that of the polymerization toner, more preferably from 1 to 15 parts by mass, even more preferably from 3 to 12 parts by mass.

The ground toner may contain any other constituent materials. For example, as the electrification control agent to be therein, any known one is usable. For example, there are known nigrosine dyes, amino group-containing vinylic copolymers, quaternary ammonium salt compounds, polyamine resins and the like for positive electrification; and for negative electrification, there are metal metal-containing azo dyes containing a metal such as chromium, zinc, iron, cobalt, aluminium or the like, metal salts and metal complexes of salicylic acid or alkylsalicylic acid with the above-mentioned metal, etc.

The amount to be used is preferably from 0.1 to 25 parts by mass relative to 100 parts by mass of resin, more preferably from 1 to 15 parts by mass. In this case, the electrification control agent may be incorporated in resin, or may be used in the form adhering to the surfaces of toner mother particles.

Of those electrification control agents, in consideration of the ability thereof to impart electrification to toner, and the color toner aptitude thereof (that is, the electrification control agent itself is colorless or is colored only faintly and therefore has no negative influence on the toner color), amino group-containing vinylic copolymers and/or quaternary ammonium salt compounds are preferred for positive electrification, and for negative electrification, metal salts and metal complexes of salicylic acid or alkylsalicylic acid with chromium, zinc, aluminium, boron or the like are preferred.

Of those, the amino group-containing vinylic copolymers include, for example, copolymer resins of aminoacrylates with styrene, methyl methacrylate or the like, such as N,N-dimethylaminomethyl acrylate, N,N-diethylaminomethyl acrylate, etc. The quaternary ammonium salt compounds include, for example, salt-forming compounds of tetraethylammonium chloride or benzyltributylammonium chloride and naphtholsulfonic acid, etc. To positive-charging toners, the amino group-containing vinylic copolymer and the quaternary ammonium salt compound may be incorporated either singly or as combined.

As the metal salts and metal complexes of salicylic acid or alkylsalicylic acid, chromium, zinc or boron complexes of 3,5-di-tertiary butylsalicylic acid are especially preferred among various known substances. The above-mentioned colorant and electrification control agent may be processed for pre-dispersion treatment by prekneading with resin, or that is, for so-called master batch treatment for improving the dispersibility and the compatibility in toner.

Preferably, the ground toner contains at least one type of a particulate additive in the surfaces of the particles. The main purpose of the additive is to improve the adhesiveness, the aggregation performance and the flowability of the toner mother particles and to improve the friction chargeability and the durability of the toner. Concretely, there are mentioned organic or inorganic, optionally surface-treated, fine particles having a mean primary particle size of from 0.001 to 5 μm, preferably from 0.002 to 3 μm, including, for example, fluororesin powders of polyvinylidene fluoride, polytetrafluoroethylene, etc.; fatty acid metal salts such as zinc stearate, calcium stearate, etc.; resin beads mainly comprising polymethyl methacrylate, silicone resin, etc.; minerals such as talc, Hydrotalcite, etc.; metal oxides such as silicon oxide, aluminium oxide, titanium oxide, zinc oxide, tin oxide, etc.

Of those, more preferred are silicon oxide fine particles, and especially preferred are silicon oxide fine particles hydrophobized on the surfaces thereof. For the method of hydrophobization, for example, there is mentioned a method of reacting silicon oxide fine particles with an organic silicon compound such as hexamethyldisilazane, trimethylsilane, dimethyldichlorosilane, silicone oil or the like, or adsorbing the latter compound to the former fine particles, and then chemically processing them. Preferably, the BET specific surface area of the fine particles falls within a range of from 20 to 200 $m^2/g$. The blending proportion of the particulate additive to the ground toner is preferably within a range of from 0.01 to 10% by mass of all the toner mother particles, more preferably from 0.05 to 5% by mass.

The wax to be in the ground toner is not also specifically defined so far as the toner for development of electrostatic images can be produced in such a manner that the dust emission (CPM) from the toner can satisfy the requirement defined in the present application. For example, there are exemplified olefinic waxes such as low-molecular-weight polyethylene, low-molecular-weight polypropylene, copolymer polyethylene, etc.; paraffin waxes; long chain aliphatic group-having ester waxes such as behenyl behenate, montanates, stearyl stearate, etc.; hydrogenated castor oil; vegetable waxes such as carnauba wax, etc.; long chain alkyl group-having ketones such as distearyl ketone, etc.; alkyl group-having silicones; higher fatty acids such as stearic acid, etc.; long chain aliphatic alcohols such as eicosanol, etc.; polyalcohol carboxylates obtained from a polyalcohol such as glycerin, pentaerythritol or the like and a long-chain fatty acid, or partial esters thereof; higher fatty acid amides such as oleic acid amide, stearic acid amide, etc.; low-molecular-weight polyesters, etc. Above all, preferred are hydrocarbon waxes (Fischer-Tropsch wax, microcrystalline wax, polyethylene wax, polypropylene wax), and ester waxes (esters of long-chain fatty acid and long-chain alcohol, esters of long-chain fatty acid and polyalcohol).

An example of the production method for the ground toner is mentioned below.

1. A resin, an electrification control agent, a colorant and any other optional additive are uniformly dispersed in a Henschel mixer, etc.

2. The dispersion is melt-kneaded in a kneader, an extruder, a roll mill, etc.

3. The kneaded mixture is roughly ground with a hammer mill, a cutter mill or the like, and then finely ground with a jet mill, an I-type mill, etc.

4. The finely ground matter is classified with a dispersion classifier, a zigzag classifier, etc.

5. Optionally, silica and the like are added to the classified fraction and further dispersed with a Henschel mixer, etc.

The grinding method toner thus obtained in the manner as above is extremely highly resistant to mechanical stress and, in addition, in continuous use thereof, the toner could be prevented from being aggregated or solidified by the generated friction heat and therefore could maintain suitable chargeability for a long period of time. Accordingly, the toner is especially favorable for nonmagnetic one-pack development system.

<Toner>

The volume median diameter (hereinafter this may be abbreviated simply as "Dv50") of the toner for development of electrostatic images is measured by dispersing the toner to have a dispersoid concentration of 0.03% by mass, using Beckman Coulter's Multisizer III (having a aperture diameter of 100 μm) and using Beckman Coulter's Isoton II as the dispersion medium. The particle size detection range is from 2.00 to 64.00 μm, and this range is discretized into 256 divisions at regular intervals on the logarithmic scale. The value calculated from the volume-based statistics is defined as the volume median diameter (Dv50). The value calculated from the number-based statistics is defined as the number median diameter (Dn50).

In the present invention, "toner" is produced by incorporating external additives and others to be mentioned below to "toner mother particles". The above-mentioned Dv50 is Dv50 of the "toner", and naturally, therefore, the "toner" is analyzed as the sample according to the above-mentioned method. However, even when the toner mother particles before addition of external additives thereto also gives substantially the same Dv50 as that of the toner, and therefore, not only the volume median diameter (Dv50) of the toner alone but also that of the toner mother particles are measured according to the above-mentioned method. Further, when a wet method toner such as that produced according to an emulsion polymerization aggregation method or the like in the form of a dispersion thereof before filtration and drying is substantially dispersed in a dispersion medium Isoton II to have a dispersoid concentration of 0.03% by mass and analyzed for the measurement, then the dispersion gives substantially the same Dv50 as that of the toner, and accordingly, the toner mother particles in the form of a dispersion thereof before filtration and drying are also analyzed for the measurement according to the above-mentioned method.

Any known external additive may be incorporated in the surfaces of the toner mother particles thus produced in the manner as above to thereby give a toner, for the purpose of controlling the flowability and the developability thereof. The external additives include metal oxides and hydroxides such as alumina, silica, titania, zinc oxide, zirconium oxide, cerium oxide, talc, Hydrotalcite, etc.; metal titanates such as calcium titanate, strontium titanate, barium titanate, etc.; nitrides such as titanium nitride, silicon nitride, etc.; carbides such as titanium carbide, silicon carbide, etc.; organic particles of acrylic resin, melamine resin, etc. Two or more different types of those additives may be combined for here herein. Above all, preferred are silica, titania and alumina; and more preferred are those surface-treated with a silane coupling agent, a silicone oil or the like.

Preferably, the mean particle size of the additive falls within a range of from 1 to 500 nm, more preferably from 5 to 100 nm. Also preferred is a combined use of small-size particles and large-size particles both falling within the above-mentioned particle size range. The amount of the external additive to be added is preferably from 0.05 to 10 parts by mass relative to 100 parts by mass of the toner mother particles, more preferably from 0.1 to 5 parts by mass.

Further, it is desirable that the value (Dv/Dn) calculated by dividing Dv by Dn is from 1.0 to 1.25, more preferably from 1.0 to 1.20, even more preferably from 1.0 to 1.15, and further desirably nearer to 1.0. The toner for development of electrostatic images that has a sharp particle size distribution tends to have uniform chargeability between individual particles, and therefore for attaining high-quality and high-speed image formation, Dv/Dn of the toner for development of electrostatic images is preferably within the above-mentioned range.

The toner for development of electrostatic images of the present invention may be used for any of magnetic two-pack developers containing a carrier for conveying the toner to the electrostatic latent image zone by magnetic force, or magnetic one-pack developers containing a magnetic powder in the toner, or nonmagnetic one-pack developers not using a magnetic powder. For remarkably expressing the advantageous effects of the present invention, the toner is favorably used especially for developers for nonmagnetic one-pack development system.

In case where the toner is used in the above-mentioned magnetic two-pack developer, the carrier to be mixed with the toner to form the developer may be any of a magnetic substance of a known magnetic powder, ferrite or magnetite carrier, etc., those prepared by coating the surface of that substance with a resin, or a magnetic resin carrier. As the resin to coat the carrier, usable is any known styrenic resin, acrylic resin, styrene-acrylic copolymer resin, silicone resin, modified silicone resin, fluororesin or the like, to which, however, the resin for use herein is not limited. The mean particle size of the carrier is not specifically defined. Preferably, the carrier has a mean particle size of from 10 to 200 μm. Preferably, the carrier is used in an amount of from 5 to 100 parts by mass relative to 1 part by mass of the toner.

EXAMPLES

The invention is described more concretely with reference to the following Examples; however, not overstepping the spirit and the scope thereof, the invention is not limited to the following Examples. In the following Examples, "part" is "part by weight".

[Measurement Methods and Definition]

<Method for Measurement of Melting Point of Wax that is in a State of being Contained in the Toner for Development of Electrostatic Images, and Definition of the Wax Melting Point>

The melting point of wax was measured through DSC.

A thermal analyzer (DSC220U/SSC5200 System) by SII Nanotechnology (formerly Seiko Instruments) was used.

The measurement was carried out in a nitrogen atmosphere. 7 mg of aluminium oxide was put in a standard pan, and 10 mg of a toner for development of electrostatic images was in a sample pan. Next, this was heated from 10° C. up to 121° C. at a rate of 10° C./min, and kept at 121° C. for 10 minutes. Next, this was cooled from 121° C. down to 10° C. at a rate of 10° C./min, and kept at 10° C. for 5 minutes. Further, this was heated from 10° C. up to 120° C. at a rate of 10° C./min, and the endothermic peak or the shoulder temperature during the second-time heating was referred as the melting point of the wax in the toner for development of electrostatic images. In other words, analyzing the peak during the second-time heating clearly reveals that the peak derived from the enthalpy relaxation accompanied by the glass transition point of the resin in the toner disappear and the melting point of the wax is clarified, and accordingly, the data taken during the second-time heating were employed for the melting point of the wax.

In addition, the melting point of the wax alone was measured according to the same method as above except that the weight of the sample was changed to 3.5 mg.

The melting point of a wax that is in a state of being contained in a toner for development of electrostatic images, and the melting point of the wax alone or a wax mixture may often differ from each other or may often give a different endothermic profile relative to the temperature in DSC, for example, in a case where the wax and a resin are mixed or the wax and a different wax are mixed, and consequently here, the melting point of the wax alone and the melting point of the wax that is in a state of being contained in a toner for development of electrostatic images were measured separately.

<Method for Measurement of Volume-Average Diameter (Mv) and Number-Average Diameter (Mn) of Pigment Dispersion, Polymer Primary Particles Dispersion and Wax Dispersion, and Definition Thereof>

The volume-average diameter (Mv) and the number-average diameter (Mn) of the pigment dispersion, the polymer primary particles dispersion and the wax dispersion were measured using Nikkiso's Model, Microtrac Nanotrac 150 (hereinafter abbreviated as "Nanotrac"). According to the instruction manual for Nanotrac and using the same company's analysis software Microtrac Particle Analyzer Ver. 10, 1.2.-019EE, the sample was analyzed according to the method described in the instruction manual and using ion-exchanged water having an electric conductivity of 0.5 μS/cm as a dispersion medium, under the condition mentioned below and by inputting the following condition into the instrument.

Conditions for the polymer primary particles dispersion and the wax dispersion are as follows:

Solvent refractive index: 1.333
Measurement time: 100 seconds
Measurement frequency: once
Particle refractive index: 1.59
Permeability: permeable
Shape: true spherical
Density: 1.04

Conditions for the pigment premix liquid and the colorant dispersion are as follows:

Solvent refractive index: 1.333
Measurement time: 100 seconds
Measurement frequency: once
Particle refractive index: 1.59
Permeability: absorbed
Shape: non-spherical
Density: 1.00

<Method for Measurement of Volume Median Diameter (Dv50) and Number Median Diameter (Dn50) of Toner for Development and Definition Thereof>

The toner obtained finally after an external additive addition step was processed for pretreatment before measurement.

0.100 g of a toner was put into a cylindrical polyethylene (PE)-made beaker having an inner diameter of 47 mm and a height of 51 mm using a spatula, and 0.15 g of an aqueous 20 mass % DBS solution (Daiichi Kogyo Seiyaku's Neogen S-20A) was thereinto using a dropper. In this step, the toner and the aqueous 20% DBS solution were put into only the bottom of the beaker, so that the toner would not scatter around the edge of the beaker, etc. Next, using a spatula, this was stirred for 3 minutes until the toner and the aqueous 20% DBS solution could form a paste. Also in this step, the toner was kept prevented from scattering around the edge of the beaker, etc.

Subsequently, 30 g of a dispersion medium Isoton II was added thereto, and stirred for 2 minutes using a spatula to give a solution that was visually uniform as a whole. Next, a fluororesin-coated rotor having a length of 31 mm and a diameter of 6 mm was put into the beaker, and the solution therein was dispersed for 20 minutes at 400 rpm using a stirrer. In this step, the macroscopic particles visually seen in the vapor/liquid interface and at the edge of the beaker were dropped down into the beaker at a rate of once per 3 minutes using a spatula thereby to give a uniform dispersion. Subsequently, this was filtered through a mesh having an opening of 63 μm, and the resultant filtrate was referred to as "toner dispersion".

For measurement of the particle size during the production step for the toner mother particles, the filtrate prepared by filtering the slurry during aggregation through a 63-μm mesh was referred to as "slurry liquid".

The median diameter (Dv50 and Dn50) of the particles was measured using Beckman Coulter's Multisizer III (aperture diameter 100 μm) (hereinafter abbreviated as "Multisizer"). As the dispersion medium, the same company's Isoton II was used. The above-mentioned "toner dispersion" or "slurry liquid" was diluted to have a dispersoid concentration of 0.03% by mass, and analyzed according to the Multisizer III analysis software. The KD value was 118.5.

The measurement particle size range was from 2.00 to 64.00 μm, and this range was discretized into 256 divisions at regular intervals on the logarithmic scale. The value calculated from the volume-based statistics was defined as the volume median diameter (Dv50). The value calculated from the number-based statistics was defined as the number median diameter (Dn50).

Of the particles having a volume median diameter (Dv50) of 1 μm or more, the volume median diameter (Dv50) was measured using Beckman Coulter's Multisizer III (aperture diameter 100 μm) (hereinafter abbreviated as "Multisizer"). As the dispersion medium, the same company's Isoton II was used, and the particles were dispersed to have a dispersoid concentration of 0.03% by mass, and analyzed. The measurement particle size range was from 2.00 to 64.00 μm, and this range was discretized into 256 divisions at regular intervals on the logarithmic scale. The value calculated from the volume-based statistics was defined as the volume median diameter (Dv50). The value calculated from the number-based statistics was defined as the number median diameter (Dn50).

<Method for Measurement of Mean Circularity and Definition Thereof>

In the present invention, the "mean circularity" is measured as follows, and defined as follows. Specifically, toner mother particles are dispersed in a dispersion medium (Isoton II, by Beckman Coulter) to be in a range of from 5720 to 7140 particles/μL. Using a flow particle image analyzer (Sysmex's FPIA3000), the sample is analyzed under the instrument condition mentioned below, and the value is defined as "mean circularity". In the present invention, the same measurement is repeated three times, and the arithmetic average of the three "mean circularity" data is employed as the "mean circularity" of the analyzed sample.

Mode: HPF

Amount for HPF analysis: 0.35 μL

Number of HPF detection particles: 8,000 to 10,000

The following is one measured in the above-mentioned instrument and automatically calculated therein and expressed. [Circularity] is defined by the following formula.

[Circularity]=[peripheral length of circle having the same area as the particle projected area]/[peripheral length of particle projected image]

From 8,000 to 10,000 particles that are the number of HPF detection particles were measured, and the arithmetic average of the circularity of each particle is displayed on the instrument as "mean circularity".

<Dust Detector>

The dust detector used in Examples is described.

FIG. 6 is a view showing a schematic configuration of the dust detector used in Examples. As shown in FIG. 6, the dust detector use in Examples is equipped with an intake port 9 through which external air or an inert gas is introduced into the draft 1, and an exhaust fan 8 having an exhaust 7 through which these gases are discharged out, and is equipped with a heating unit (hot plate) 2 for heating the sample 4 put in the sample cup (aluminium cup) 3 in the draft 1 to measure the dust emission. Above the heating unit 2, arranged is a funnel-like cone collector 10 for collecting the dust emitted in heating the sample 4 put in the sample cup 3 with the heating unit 2. The cone collector 10 is connected to the dust meter 6 via the suction duct 5.

In FIG. 6, the sample cup 3 is cylindrical, but in fact, the inventors used a mortar-shaped one. However, the shape of the sample cup is not specifically defined so far as the top of the opening thereof is narrowed.

In the dust detector shown in FIG. 6, SHIBATA' digital dust indicator "DustMate LD-3K2 Model" was used as the dust counter 6. As the draft 1, used was Labohood FUMR-HOOD LF-600 Set (aeration: 6.7 $m^3$/min, static pressure: 0.36 kPa, consumption power: 93 W). Further, as the exhaust fan 8, used was Mitsubishi Electric's NS-K-20PS.

FIG. 7 is an explanatory view showing the concrete configuration and size of the draft 1 of the dust detector shown in FIG. 6. In FIG. 7, each length (cm) shows the concrete length of each part of the draft 1 used in the dust detector in Examples. In FIG. 7, 1*a* is an air intake port (vapor intake port) for draft also serving as a power source cable port, and has a diameter of 3 cm. In FIG. 7, 1*b* is an exhaust port for draft, and has a diameter of 10 cm. In FIG. 7, the draft 1 and the exhaust fan 8 are shown as divided; however, as in FIG. 6, the exhaust fan 8 communicates with the exhaust port 1*b* for draft. The draft 1 is openable and closable at the part of 28 cm×60 cm in the front of the device, and the sample may be take in and take out via the part.

FIG. 8 is a plan view of a part of the inside of the dust detector shown in FIG. 6, as seen from the top thereof. As shown in FIG. 8, the sample cup (aluminium cup) 3 put on the heating unit (hot plate) 2 is so arranged that the center of the sample cup is positioned as separated by 20 cm from the right-hand wall 1*c* of the draft 1 and as separated by 25 cm from the back-side wall 1*d* of the draft 1. The sample cup (aluminium cup) 3 has a diameter of 6 cm. The height 12 cm in FIG. 8 indicates the height from the floor of the draft 1 up to the surface of the sample put in the sample cup 3.

FIG. 9 is a view explaining the positional relationship in the height direction of the heating unit (hot plate) 2, the sample cup (aluminium cup) 3 and the cone collector 10, the size of the suction duct 5 connected to the cone collector 10, and the positional relationship in the height direction of the suction duct 5 and the dust counter 6, in the dust detector shown in FIG. 6.

As shown in FIG. 9, the lower edge of the funnel-like part of the cone collector 10 is arranged at the position of 7 cm in the upper direction from the sample cup (aluminium cup) 3 put on the heating unit (hot plate) 2. The height from the lower edge of the funnel-like part of the cone collector 10 to the top edge of the funnel-like part is 12 cm. Further, the length (height) from the top edge of the funnel-like part of the cone collector 10 to the connection at which the part is connected to the suction duct 5 is 10 cm. The diameter of the lower edge of the funnel-like part of the cone collector 10 is 15 cm. Further, the length of the suction duct 5 is 50 cm, and the inner diameter of the suction duct 5 is 1.5 cm. The suction duct 5 used here is a polypropylene-made one.

As shown in FIG. 9, the dust detector is equipped with a thermometer 2*a* for measuring the surface temperature of the heating unit (hot plate) 2, and a sample thermometer 4*a* for measuring the surface temperature of the sample kept in the sample cup (aluminium cup) 3.

<Method for Measurement of Dust Emission (Dt) from Toner for Development of Electrostatic Images and Dust Emission (Dw) from Wax, and Definition Thereof>

Using the dust detector shown in FIGS. 6 to 9, the dust amount emitted from a sample was measured under the condition and according to the process shown below, in the draft 1 controlled at a temperature of 22 to 28° C. and at a humidity of 50 to 60%.

(I) The exhaust fan 8 was driven, and immediately after the heating unit (hot plate) 2 was heated up to 200° C., its temperature was lowered to 100° C., and this was kept at 100° C. The meaning why the heating unit is heated up to 200° C. is in order that the dust value emitted from any others than the sample at the dust measurement maximum temperature is contained in the background (BG) value.

(II) While the heating unit 2 was kept at 100° C., the background (BG) measurement (1 minute) in the dust counter 6 and the dust calibration value measurement were carried out. Further, after the actual measurement in (III), the same background measurement for 1 minute was carried out, and the mean value of the two background values measured before and after the actual measurement in (III) was employed as the background value.

(III) While the heating unit 2 was kept at 100° C., from 1.0 to 1.1 g of the sample 4 was weighed in the sample cup (aluminium cup) 3 having a diameter of 6 cm, and put at the center of the heating unit 2. From the nitrogen introduction port 3*a* shown in FIG. 9, a nitrogen gas was introduced into the sample cup 3 at a flow rate of 100 ml/min via a duct having an inner diameter of 2 mm, thereby making the sample in an inert atmosphere. Though not shown in FIGS. 6 to 9, a duct is introduced from outside the draft 1 to near the sample cup 3, so that nitrogen gas can run through the duct and can be discharged out via the nitrogen introduction port 3*a* to thereby make the sample kept in an inert atmosphere. In FIG. 9, the duct is shown only near the sample cup 3 and the nitrogen introduction port 3*a* is clearly shown therein.

The meaning of the nitrogen gas introduction is in order that the sample is prevented from being in a dangerous state by firing through oxidation reaction or the like and in order that the sample is heated in such an inert gas atmosphere. Consequently, the nitrogen gas introduction was carried out at an extremely low flow rate (100 ml/min) in order that the nitrogen gas flow would not interfere with the dust collection by the cone collector 10. Here, the sample is a toner for development of electrostatic images or a wax alone.

(IV) From 100° C., the heating unit 2 was further heated up to 200° C. according to a programmed mode, taking 60 minutes, and thereafter kept at 200° C. for 5 minutes. The dust emitted during the period of 65 minutes was counted at intervals of 1 minute by the use of the dust counter. The total of the values thus measured 65 times provided the dust value before the background was taken into consideration. Subsequently, the background (BG) value previously measured in (II) was subtracted from the above data, thereby giving the dust emission (Dt) from the toner for development of electrostatic images, or the wax dust emission (Dw).

For example, a case of sample analysis is described, in which the sum total in measurement of 65 times at intervals of 1 minute according to the temperature profile described in (III) without consideration of background is 345 CPM, the background measurement value (before sample measurement) for 1 minute is 3 CPM, and the background measurement value (after sample measurement) is 4 CPM, then 345−((3+4)/2))×65=118, and accordingly, 118 is shown as the proper dust emission from the sample in Table 2.

The unit is "CPM" displayed on a dust counter, SHIBATA's digital indicator "DustMate LD-3K2 Model".

<Fixation Test: Method for Measurement of Hot Offset Resistance and Method for Evaluation Thereof>

Using a color page printer ML 9600PS (by Old data) in a test, the development bias and the supply bias were controlled, and a solid image having a size of 201 mm×287 mm was actually printed on excellent white A4 size paper (by Old Data) at intervals of an image density 0.2 in an image density range of from 1.0 to 2.0 on a photoreceptor. For stabilizing the temperature of the fixing unit, 30 sheets were printed at every image density, and the final one sheet was evaluated. The toner with which the final one sheet having an image density of 1.6 or less had a blister (uneven glossiness) caused by hot offset was evaluated as not good (x); the toner with which the sheet having an image density of more than 1.6 and 1.8 or less had a blister was evaluated as average (O); and the toner with which the sheet having an image density of more than 1.8 did not still have a blister was evaluated as excellent (OO); and in that manner, the hot offset resistance of the toner tested was evaluated. The machine process speed was 36 sheets/min in terms of A4 short side feed.

<Method for Measurement of Dust Emission Rate (Vd) and Definition Thereof>

All four cartridges of a color page printer ML 9600PS (by Oki data) were filled with the toner for development produced according to the method mentioned below. Using high-quality paper PA4 (by Fuji Xerox), the dust was collected according to the measurement method certified by the Blue Angel Mark (RAL_UZ122_2006), and from the mass measurement of the substance collected on the filter, the dust emission rate was determined.

Concretely, the emission test chamber (VOC-010/volume 1000 L/by Espec) was previously baked. After blank measurement, the above-mentioned printer and the dust counting filter were set, and the system was kept stand-by for 60 minutes or more until the temperature and the humidity in the tank could reach the rated values (23±2° C./50×5%). The printer was driven by remote operation and at the same time suction through the filter was started. After a prescribed number of sheets were printed and for further 2 hours, the suction collection was continued. The print pattern used here is VE110-7, Version 2006-06-01 (RAL_UZ122/RALC00.PDF).

The dust emission rate was calculated according to the following formulae.

Dust Mass after temperature humidity correction, $$mSt=(mMF\text{brutto}-mMF\text{tara})+(mRF1-mRF2) \quad (1)$$

mMFtara: mass of mass-stabilized measurement filter before dust sample collection (mg)

mMFbrutto: mass of mass-stabilized measurement filter after dust sample collection (mg)

mRF1: mass of standard filter before test (mg)

mRF2: mass of standard filter after test (mg)

$$Vd=(mST\times n\times V\times to)/(VS\times tp) \quad (2)$$

Vd: dust emission rate (mg/hr)

n: ventilation frequency (h−1)

to: total sampling time (min)

tp: printing time (min)

V: chamber volume ($m^3$)

VS: volume of air sucked after having passed through filter ($m^3$)

The toner having Vd of 0.7 or less was evaluated as excellent (OO), the toner having Vd of more than 0.7 and 3.0 or less was evaluated as good (O), and the sample having Vd of more than 3.0 was evaluated as not good (x).

<Method for Measurement of BET Specific Surface Area of External Additive, and Definition Thereof The BET specific surface area was measured according to the one-point method using liquid nitrogen, using Mountech's Macsorb Model-1201. Concretely, the method is as follows.

First, about 1.0 g of the test sample was charged in a glass-made dedicated cell (hereinafter the charged sample amount is referred to as A (g)). Next, the cell was set on the apparatus body, and dried and degassed in a nitrogen atmosphere at 200° C. for 20 minutes, and then the cell was cooled to room temperature. Subsequently, while the cell was cooled with liquid nitrogen, a measurement gas (first-rate mixed gas of 30% nitrogen/70% helium) was introduced thereinto at a flow rate of 25 mL/min, and the adsorption of the measurement gas to the sample, V ($cm^3$) was measured. The total surface area of the sample is referred to as S ($m^2$), and the targeted BET specific surface area ($m^2/g$) can be calculated by the following math formula.

$$\text{(BET specific surface area)}=S/A=\{K\times(1-P/P_0)\times V\}/A$$

K: gas constant (in this measurement, 4.29)

$P/P_0$: relative pressure of adsorbed gas, 97% of the mix ratio (in this measurement, 0.29)

Example 1

Preparation of Colorant Dispersion 20 parts of carbon black produced according to a furnace process, of which the toluene extract has a UV absorbance of 0.02 and which has a true density of 1.8 g/$cm^3$, (by Mitsubishi Chemical, Mitsubishi carbon black MA100S), 1 part of anionic surfactant (by Daiichi Kogyo Seiyaku, Neogen S-20D), 4 parts of nonionic surfactant (by Kao, Emulgen 120), and 75 parts of ion-exchanged water having conductivity of 1 μS/cm were put in the chamber of a stirrer equipped with a propeller, and predispersed therein to give a pigment premix liquid. After premixed, the volume median diameter Dv50 of the carbon black in the dispersion was about 90 μm.

The premix liquid was used as a starting slurry, and fed into a wet bead mill and dispersed therein in one-pass operation. The inner diameter of the stator was 120 mmφ, the diameter of the separator was 60 mmφ, and the diameter of the zirconia beads (true density 6.0 g/$cm^3$) used as dispersion media was 50 μm. The effective internal volume of the stator was about 2 liters, the volume filled with the media was 1.4 liters, and therefore the media-filling rate was 70%.

The rotation speed of the rotor was set constant (the peripheral speed of the rotor tip was about 11 m/sec), and the above-mentioned premix slurry was fed through the supply port via a non-pulsatile metering pump at a supply rate of about 40 liter/hr, and at the time when the particles reached a predetermined particle size, the product was taken out of the discharge port. During the operation, cooling water at about 10° C. was circulated through the jacket, and a colorant dispersion having a volume-average diameter (Mv) of 160 nm and a number-average diameter (Mn) of 104 nm was thus produced.

<Preparation of Wax Dispersion A1>

26.7 parts (1068 g) of HiMic-1090 (by Nippon Seiro: melting point 82° C. (89° C. in catalog)), 3.0 parts of pentaerythritol tetrastearate (acid value 3.0, hydroxyl value 1.0, melting point 77° C. and 67° C.), and 0.3 parts of decaglycerin decabehenate (hydroxyl value 27, melting point 70° C.) were put into the jacketed pot of a homogenizer equipped with a pressure circulation line (Gaulin's LAB60-10TBS Model) and heated with stirring at 95° C. for 30 minutes. Subsequently, a mixture prepared by previously heating 2.8 parts of aqueous 20% sodium dodecylbenzenesulfonate (Daiichi Kogyo Seiyaku's Neogen S20D, hereinafter abbreviated as aqueous 20% DBS solution) and 67.2 parts of desalted water at 95° C. was added thereto, and heated at 100° C. for primary circulating emulsification under pressure at 10 MPa.

The volume median diameter was measured at intervals of 10 minutes, and when the median diameter lowered to around 500 nm or so, the pressure was further increased up to 25 MPa for subsequent secondary circulating emulsification. This was dispersed until the volume median diameter could reach 230 nm, and then immediately cooled to give a wax dispersion A1 (emulsion solid concentration=30.3%).

On the other hand, a mixture prepared by heating 26.7 parts of HiMic-1090 (by Nippon Seiro: melting point 82° C. (89° C. in catalog)), 3.0 parts of pentaerythritol tetrastearate (acid value 3.0, hydroxyl value 1.0, melting point 77° C. and 67° C.), and 0.3 parts of decaglycerin decabehenate (hydroxyl value 27, melting point 70° C.) with stirring at 95° C. for 30 minutes was cooled to room temperature, and the dust emission (Dw) from the resultant wax mixture (wax A1) was 26,723 CPM.

<Preparation of Wax Dispersion A2>

27 parts (1080 g) of paraffin wax (Nippon Seiro's HNP-9, melting point 76° C.) and 2.8 parts of stearyl acrylate (by Tokyo Chemical) were put into the jacketed pot of a homogenizer equipped with a pressure circulation line (Gaulin's LAB60-10TBS Model) and heated with stirring at 90° C. for 30 minutes. Subsequently, a mixture prepared by previously heating 1.9 parts of 20% DBS and 68.3 parts of desalted water at 90° C. was added thereto, and heated at 90° C. for primary circulating emulsification under pressure at 10 MPa. The volume median diameter was measured at intervals of 10 minutes, and when the median diameter lowered to around 500 nm or so, the pressure was further increased up to 20 MPa for subsequent secondary circulating emulsification. This was dispersed until the volume median diameter could reach 230 nm, and then immediately cooled to give a wax dispersion A2 (emulsion solid concentration=29.4%).

On the other hand, a mixture prepared by heating 27 parts (540 g) of paraffin wax (Nippon Seiro's HNP-9, melting point 76° C.) and 2.8 parts of stearyl acrylate (by Tokyo Chemical) with stirring at 95° C. for 30 minutes was cooled to room temperature, and the dust emission (Dw) from the resultant wax mixture (wax A2) was 155,631 CPM.

<Preparation of Polymer Primary Particles Dispersion B1>

35.0 parts (700.1 g) of the wax dispersion A1 and 259 g of desalted water were put into a reactor equipped with a stirrer (three impellers), a heating and cooling unit, a condenser and a starting material/auxiliary agent feeder, and heated up to 90° C. in a nitrogen stream atmosphere with stirring. Subsequently, while the liquid was kept stirred, a mixture of "polymerizing monomers, etc." and "aqueous emulsifier solution" mentioned below was added thereto, taking 5 hours. The time at which adding the mixture was started is referred to as "polymerization start". In 30 minutes after the polymerization start, the following "aqueous initiator solution" was added to the system, taking 4.5 hours, and further in 5 hours after the polymerization start, the following "additional aqueous initiator solution" was added thereto, taking 2 hours. While further kept stirred, the system was kept as such at an internal temperature of 90° C. for 1 hour.

| [Polymerizing Monomers, etc.] | |
|---|---|
| Styrene | 75.9 parts |
| Butyl acrylate | 24.1 parts |
| Acrylic acid | 1.2 parts |

-continued

| | |
|---|---|
| Hexanediol diacrylate | 0.73 parts |
| Trichlorobromomethane | 1.0 part |
| [Aqueous Emulsifier Solution] | |
| Aqueous 20% DBS solution | 1.0 part |
| Desalted water | 67.0 parts |
| [Aqueous Initiator Solution] | |
| Aqueous 8 mass % hydrogen peroxide solution | 15.5 parts |
| Aqueous 8 mass % L(+)-ascorbic acid solution | 15.5 parts |
| [Additional Aqueous Initiator Solution] | |
| Aqueous 8 mass % L(+)-ascorbic acid solution | 14.2 parts |

After the polymerization reaction, the system was cooled. This operation was repeated twice, and the two polymer primary particles dispersions obtained in the two operations were uniformly mixed to give a milky polymer primary particles dispersion B1. The volume-average diameter (Mv), as measured with Nanotrac, was 242 nm, and the solid concentration was 22.7% by mass. The binder resin/wax ratio in the polymer primary particles dispersion B1 and Dw of the wax used are shown in Table 1.

<Preparation of Polymer Primary Particles Dispersion B2>

36.1 parts (722.2 g) of the wax dispersion A2 and 259 g of desalted water were put into a reactor equipped with a stirrer (three impellers), a heating and cooling unit, a condenser and a starting material/auxiliary agent feeder, and heated up to 90° C. in a nitrogen stream atmosphere with stirring. Subsequently, while the liquid was kept stirred, a mixture of "polymerizing monomers, etc." and "aqueous emulsifier solution" mentioned below was added thereto, taking 5 hours. The time at which adding the mixture was started is referred to as "polymerization start". In 30 minutes after the polymerization start, the following "aqueous initiator solution" was added to the system, taking 4.5 hours, and further in 5 hours after the polymerization start, the following "additional aqueous initiator solution" was added thereto, taking 2 hours. While further kept stirred, the system was kept as such at an internal temperature of 90° C. for 1 hour.

| | |
|---|---|
| [Polymerizing Monomers, etc.] | |
| Styrene | 76.8 parts |
| Butyl acrylate | 23.2 parts |
| Acrylic acid | 1.5 parts |
| Hexanediol diacrylate | 0.70 parts |
| Trichlorobromomethane | 1.0 part |
| [Aqueous Emulsifier Solution] | |
| Aqueous 20% DBS solution | 1.0 part |
| Desalted water | 67.1 parts |
| [Aqueous Initiator Solution] | |
| Aqueous 8 mass % hydrogen peroxide solution | 15.5 parts |
| Aqueous 8 mass % L(+)-ascorbic acid solution | 15.5 parts |
| [Additional Aqueous Initiator Solution] | |
| Aqueous 8 mass % L(+)-ascorbic acid solution | 14.2 parts |

After the polymerization reaction, the system was cooled to give a milky polymer primary particles dispersion B2. The volume-average diameter (Mv), as measured with Nanotrac, was 232 nm, and the solid concentration was 22.6% by mass. The binder resin/wax ratio in the polymer primary particles dispersion B2 and Dw of the wax used are shown in Table 1.

TABLE 1

| | Unit | Polymer Primary Particles Dispersion B1 | Polymer Primary Particles Dispersion B2 |
|---|---|---|---|
| Wax Dispersion | | A1 | A2 |
| Dust Emission from Wax (Dw) | CPM | 26,723 | 155,631 |
| Amount of Binder Resin (as solid content) | part | 100 | 100 |
| Amount of Wax (as solid content) | part | 10 | 10 |

<Preparation of Toner Mother Particles C1>

Using the ingredients mentioned below, toner mother particles C1 were produced according to the aggregation step and the rounding step mentioned below. The solid fractions to constitute the ingredients of the toner mother particles for development are as mentioned below.

As the core part,

Polymer primary particles dispersion B1: 90 parts as the solid fraction (polymer primary particles dispersion B1: 4011 g)

Colorant fine particles dispersion: 6.0 parts as the colorant solid fraction

As the shell part,

Polymer primary particles dispersion B2: 10 parts as the solid fraction (polymer primary particles dispersion B2: 448 g)

(Core Part Aggregation Step)

The polymer primary particles dispersion B1 (4011 g) and aqueous 20% DBS solution (2.53 g) were put into a mixer (volume 12 liters, inner diameter 208 mm, height 355 mm) equipped with a stirrer (double-helical impeller), a heating and cooling unit, a condenser and a starting material/auxiliary agent feeder, and uniformly mixed at an internal temperature of 10° C. for 5 minutes. Subsequently, desalted water (541.5 g) was added thereto, and while kept stirred at an internal temperature of 10° C. and at 250 rpm, aqueous 5% ferrous sulfate ($FeSO_4.7H_2O$) solution (113.2 g) was added thereto, taking 5 minutes, and then the colorant fine particles dispersion (303.5 g) was added, taking 5 minutes, and uniformly mixed at an internal temperature of 10° C. Further still under the same condition, aqueous 0.5% aluminium sulfate solution (101.2 g) was added thereto, and subsequently desalted water (101.2 g) was added. Next, this was heated up to 54° C., and while kept stirred at a rotation number of 250 rpm, the internal temperature was stepwise elevated from 54.0° C. up to 56.0° C., taking 160 minutes. Using a multisizer, the volume median diameter (Dv50) was measured, and the particles were further grown up to 6.81 μm.

(Shell Coating Step)

Subsequently, the polymer primary particles dispersion B2 (447.6 g) was added thereto, taking 8 minutes, and then the system was kept as such for 30 minutes.

(Rounding Step)

Next, the rotation number was lowered to 150 rpm, and then aqueous 20% DBS solution (303.5 g) was added, taking 8 minutes, and further, desalted water (232.5 g) was added. Subsequently, this was heated up to 90° C., taking 77 minutes, and the heating and the stirring was continued until the mean circularity could reach 0.967. Next, this was cooled down to 30° C., taking 20 minutes, to give a slurry liquid.

(Washing and Drying Step)

The whole amount of the resultant slurry was filtered using a wet-type electromagnetic sieve shaker equipped with a sieve having an opening of 24 μm (AS200 by Retsch) to thereby remove coarse particles, and then the resultant slurry was once stored in a tank equipped with a stirrer. Subsequently, the slurry was dewatered and washed under an acceleration of 800 G, using a horizontal centrifuge (HZ40Si Model by Mitsubishi Kakoki) provided with a filter cloth (polyester TR815C, Nakao Filter Industry/thickness 0.3 mm/air permeation 48 (cc/cm$^2$/min)).

Ion-exchanged water having an electric conductivity of 1 μS/cm was added in an amount of about 50 times the slurry solid content at a speed not causing overflow from the rim, whereupon the electric conductivity of the filtrate reached 2 μS/cm. Finally, water was fully removed off, and the cake was collected with a scraper. Here, the collected cake was spread in a stainless vat to a height of 20 mm, and dried in a fan drier set at 40° C. for 48 hours to give toner mother particles C1.

External additives were added to the resultant toner mother particles according to the external addition step mentioned below to produce a toner for development.

<Preparation of Toner D1 for Development>

(External Addition Step)

The resulting toner mother particles C1 (100 parts: 250 g) were put into an external addition machine (Kyoritsu Riko's SK-M2000 Model), and then, as external additives, 0.5 parts of silica fine particles hydrophobized with silicone oil and having a volume-average primary particle size of 8 nm and a BET specific surface area of 150 m$^2$/g, 0.3 parts of silica fine particles hydrophobized with silicone oil and having a volume-average primary particle size of 40 nm and a BET specific surface area of 42 m$^2$/g, and 1.5 parts of silica fine particles hydrophobized with hexamethyldisilazane and having a volume-average primary particle size of 110 nm and a BET specific surface area of 26 m$^2$/g were added thereto, and mixed for 1 minute at 6000 rpm, repeatedly for a total of 5 times, and then this was sieved through a 150-mesh sieve to give a toner D1 for development.

The volume median diameter (Dv50) of the resultant toner D1 for development was 7.09 μm, the number median diameter (Dn) thereof was 6.52 μm, and the mean circularity thereof was 0.967. The melting point of the wax that is in a state of being contained in the toner for development was 77° C. and 66° C. in the order of the depth of the endothermic peak. The dust emission (Dt) from the toner D1 for development, and the dust emission rate (Vd) emitted from the image forming device using the toner D1 for development were measured, and the results are shown in Table 2.

Example 2

Preparation of Toner Mother Particles C2

Using the ingredients mentioned below, toner mother particles C2 were produced according to the aggregation step and the rounding step mentioned below. The solid fractions to constitute the ingredients of the toner mother particles for development are as mentioned below.

As the core part,

Polymer primary particles dispersion B1: 80 parts as the solid fraction (polymer primary particles dispersion B1: 3607 g)

Colorant fine particles dispersion: 6.0 parts as the colorant solid fraction

As the shell part,

Polymer primary particles dispersion B2: 20 parts as the solid fraction (polymer primary particles dispersion B2: 906 g)

(Core Part Aggregation Step)

The polymer primary particles dispersion B1 (3607 g) and aqueous 20% DBS solution (2.56 g) were put into a mixer (volume 12 liters, inner diameter 208 mm, height 355 mm) equipped with a stirrer (double-helical impeller), a heating and cooling unit, a condenser and a starting material/auxiliary agent feeder, and uniformly mixed at an internal temperature of 10° C. for 5 minutes. Subsequently, desalted water (487.0 g) was added thereto, and while kept stirred at an internal temperature of 10° C. and at 250 rpm, aqueous 5% ferrous sulfate ($FeSO_4.7H_2O$) solution (113.2 g) was added thereto, taking 5 minutes, and then the colorant fine particles dispersion (307.1 g) was added, taking 5 minutes, and uniformly mixed at an internal temperature of 10° C. Further still under the same condition, aqueous 0.5% aluminium sulfate solution (102.4 g) was added thereto, and subsequently desalted water (102.4 g) was added. Next, this was heated up to 54° C., and while kept stirred at a rotation number of 250 rpm, the internal temperature was stepwise elevated from 54.0° C. up to 56.0° C., taking 200 minutes. Using a multisizer, the volume median diameter (Dv50) was measured, and the particles were further grown up to 6.82

(Shell Coating Step)

Subsequently, the polymer primary particles dispersion B2 (905.8 g) was added thereto, taking 8 minutes, and then the system was kept as such for 30 minutes.

(Rounding Step)

Next, the rotation number was lowered to 150 rpm, and then aqueous 20% DBS solution (307.1 g) was added, taking 8 minutes, and further, desalted water (232.9 g) was added. Subsequently, this was heated up to 90° C., taking 74 minutes, and the heating and the stirring was continued until the mean circularity could reach 0.965. Next, this was cooled down to 30° C., taking 20 minutes, to give a slurry liquid.

(Washing and Drying Step)

The slurry prepared here was washed and dried according to the same method as in Example 1 to give toner mother particles C2.

<Preparation of Toner D2 for Development>

External additives were added to the toner mother particles C2 according to the same method as in Example 1 to give a toner D2 for development. The volume median diameter (Dv) of the resultant toner D2 for development was 7.25 μm, the number median diameter (Dn) thereof was 6.65 μm, and the mean circularity thereof was 0.966. The melting point of the wax that is in a state of being contained in the toner for development was 76° C. and 66° C. in the order of the depth of the endothermic peak. The dust emission (Dt) from the toner D2 for development, and the dust emission rate (Vd) from the image forming device using the toner D2 for development were measured, and the results are shown in Table 2.

Example 3

<Preparation of Toner Mother Particles C3>

Using the ingredients mentioned below, toner mother particles C3 were produced according to the aggregation step and the rounding step mentioned below. The solid fractions to constitute the ingredients of the toner mother particles for development are as mentioned below.

As the core part,

Polymer primary particles dispersion B1: 90 parts as the solid fraction (polymer primary particles dispersion B1: 4011 g)

Polymer primary particles dispersion B2: 10 parts as the solid fraction (polymer primary particles dispersion B2: 448 g)

Colorant fine particles dispersion: 6.0 parts as the colorant solid fraction

The shell part was omitted.

(Core Part Aggregation Step)

The polymer primary particles dispersion B1 (4010.9 g), the polymer primary particles dispersion B2 (447.6 g) and aqueous 20% DBS solution (2.53 g) were put into a mixer (volume 12 liters, inner diameter 208 mm, height 355 mm) equipped with a stirrer (double-helical impeller), a heating and cooling unit, a condenser and a starting material/auxiliary agent feeder, and uniformly mixed at an internal temperature of 10° C. for 5 minutes. Subsequently, desalted water (541.5 g) was added thereto, and while kept stirred at an internal temperature of 10° C. and at 250 rpm, aqueous 5% ferrous sulfate ($FeSO_4.7H_2O$) solution (113.2 g) was added thereto, taking 5 minutes, and then the colorant fine particles dispersion (303.5 g) was added, taking 5 minutes, and uniformly mixed at an internal temperature of 10° C. Further still under the same condition, aqueous 0.5% aluminium sulfate solution (202.3 g) was added thereto. Next, this was heated up to 54° C., and while kept stirred at a rotation number of 250 rpm, the internal temperature was stepwise elevated from 54.0° C. up to 56.0° C., taking 200 minutes. Using a multisizer, the volume median diameter (Dv50) was measured, and the particles were further grown up to 7.27 urn.

(Rounding Step)

Next, the rotation number was lowered to 150 rpm, and then aqueous 20% DBS solution (303.5 g) was added, taking 8 minutes, and further, desalted water (232.5 g) was added. Subsequently, this was heated up to 90° C., taking 72 minutes, and the heating and the stirring was continued until the mean circularity could reach 0.967. Next, this was cooled down to 30° C., taking 20 minutes, to give a slurry liquid.

(Washing and Drying Step)

The slurry prepared in the previous step was washed and dried according to the same method as in Example 1 to give toner mother particles C3.

<Preparation of Toner D3 for Development>

External additives were added to the toner mother particles C3 according to the same method as in Example 1 to give a toner D3 for development. The volume median diameter (Dv) of the resultant toner D3 for development was 7.14 μm, the number median diameter (Dn) thereof was 6.51 μm, and the mean circularity thereof was 0.968. The melting point of the wax that is in a state of being contained in the toner for development was 78° C. and 66° C. in the order of the depth of the endothermic peak. The dust emission (Dt) from the toner D3 for development, and the dust emission rate (Vd) from the image forming device using the toner for development were measured, and the results are shown in Table 2.

Comparative Example 1

<Preparation of Toner Mother Particles C4>

Using the ingredients mentioned below, toner mother particles C4 were produced according to the aggregation step and the rounding step mentioned below. The solid fractions to constitute the ingredients of the toner mother particles for development are as mentioned below.

As the core part,

Polymer primary particles dispersion B1: 90 parts as the solid fraction (polymer primary particles dispersion B1: 4013 g)

Colorant fine particles dispersion: 6.0 parts as the colorant solid fraction

As the shell part,

Polymer primary particles dispersion B1: 10 parts as the solid fraction (polymer primary particles dispersion B1: 446 g)

(Core Part Aggregation Step)

The polymer primary particles dispersion B1 (4012.5 g) and aqueous 20% DBS solution (2.53 g) were put into a mixer (volume 12 liters, inner diameter 208 mm, height 355 mm) equipped with a stirrer (double-helical impeller), a heating and cooling unit, a condenser and a starting material/auxiliary agent feeder, and uniformly mixed at an internal temperature of 10° C. for 5 minutes. Subsequently, desalted water (541.7 g) was added thereto, and while kept stirred at an internal temperature of 10° C. and at 250 rpm, aqueous 5% ferrous sulfate ($FeSO_4.7H_2O$) solution (113.2 g) was added thereto, taking 5 minutes, and then the colorant fine particles dispersion (303.6 g) was added, taking 5 minutes, and uniformly mixed at an internal temperature of 10° C. Further still under the same condition, aqueous 0.5% aluminium sulfate solution (101.2 g) was added thereto, and subsequently desalted water (101.2 g) was added. Next, this was heated up to 54° C., and while kept stirred at a rotation number of 250 rpm, the internal temperature was stepwise elevated from 54.0° C. up to 56.0° C., taking 165 minutes. Using a multisizer, the volume median diameter (Dv50) was measured, and the particles were further grown up to 6.85 μm.

(Shell Coating Step)

Subsequently, the polymer primary particles dispersion B1 (445.8 g) was added thereto, taking 8 minutes, and then the system was kept as such for 30 minutes.

(Rounding Step)

Next, the rotation number was lowered to 150 rpm, and then aqueous 20% DBS solution (303.6 g) was added, taking 8 minutes, and further, desalted water (232.5 g) was added. Subsequently, this was heated up to 90° C., taking 75 minutes, and the heating and the stirring was continued until the mean circularity could reach 0.969. Next, this was cooled down to 30° C., taking 20 minutes, to give a slurry liquid.

(Washing and Drying Step)

The slurry prepared in the previous step was washed and dried according to the same method as in Example 1 to give toner mother particles C4.

<Preparation of Toner D4 for Development>

External additives were added to the toner mother particles C4 according to the same method as in Example 1 to give a toner D4 for development. The volume median diameter (Dv50) of the resultant toner D4 for development was 7.03 μm, the number median diameter (Dn50) thereof was 6.42 μm, and the mean circularity thereof was 0.968. The melting point of the wax that is in a state of being contained in the toner for development was 82° C. and 66° C. in the order of the depth of the endothermic peak. The dust emission (Dt) from the toner D4 for development, and the dust emission rate (Vd) from the image forming device using the toner D4 for development were measured, and the results are shown in Table 2.

Comparative Example 2

<Preparation of Toner Mother Particles C5>

Using the ingredients mentioned below, toner mother particles C5 were produced according to the aggregation step and the rounding step mentioned below. The solid fractions to constitute the ingredients of the toner mother particles for development are as mentioned below.

As the core part,

Polymer primary particles dispersion B2: 90 parts as the solid fraction (polymer primary particles dispersion B2: 4011 g)

Colorant fine particles dispersion: 6.0 parts as the colorant solid fraction

As the shell part,

Polymer primary particles dispersion B2: 10 parts as the solid fraction (polymer primary particles dispersion B2: 447 g)

(Core Part Aggregation Step)

The polymer primary particles dispersion B2 (4010.9 g) and aqueous 20% DBS solution (2.53 g) were put into a mixer (volume 12 liters, inner diameter 208 mm, height 355 mm) equipped with a stirrer (double-helical impeller), a heating and cooling unit, a condenser and a starting material/auxiliary agent feeder, and uniformly mixed at an internal temperature of 10° C. for 5 minutes. Subsequently, desalted water (541.5 g) was added thereto, and while kept stirred at an internal temperature of 10° C. and at 250 rpm, aqueous 5% ferrous sulfate ($FeSO_4.7H_2O$) solution (113.2 g) was added thereto, taking 5 minutes, and then the colorant fine particles dispersion (303.5 g) was added, taking 5 minutes, and uniformly mixed at an internal temperature of 10° C. Further still under the same condition, aqueous 0.5% aluminium sulfate solution (404.7 g) was added thereto, and subsequently desalted water (202.3 g) was added. Next, this was heated up to 54° C., and while kept stirred at a rotation number of 250 rpm, the internal temperature was stepwise elevated from 54.0° C. up to 56.0° C., taking 150 minutes. Using a multisizer, the volume median diameter (Dv50) was measured, and the particles were further grown up to 6.69 μm.

(Shell Coating Step)

Subsequently, the polymer primary particles dispersion B2 (447.6 g) was added thereto, taking 8 minutes, and then the system was kept as such for 30 minutes.

(Rounding Step)

Next, the rotation number was lowered to 150 rpm, and then aqueous 20% DBS solution (303.5 g) was added, taking 8 minutes, and further, desalted water (248.7 g) was added. Subsequently, this was heated up to 90° C., taking 76 minutes, and the heating and the stirring was continued until the mean circularity could reach 0.967. Next, this was cooled down to 30° C., taking 20 minutes, to give a slurry liquid.

(Washing and Drying Step)

The slurry prepared here was washed and dried according to the same method as in Example 1 to give toner mother particles C5.

<Preparation of Toner D5 for Development>

External additives were added to the toner mother particles C5 according to the same method as in Example 1 to give a toner D5 for development. The volume median diameter (Dv) of the resultant toner D5 for development was 7.02 μm, the number median diameter (Dn) thereof was 6.51 μm, and the mean circularity thereof was 0.967. The melting point of the wax that is in a state of being contained in the toner for development was 76° C. and 73° C. in the order of the depth of the endothermic peak. The dust emission (Dt) from the toner D5 for development, and the dust emission rate (Vd) from the image forming device using the toner for development were measured, and the results are shown in Table 2.

TABLE 2

| | | unit | Example 1 | Example 2 | Example 3 | Comparative Example 1 | Comparative Example 2 |
|---|---|---|---|---|---|---|---|
| Schematic Configuration | ○ wax component A1<br>● wax component A2 | | | | | | |
| Amount (part) of Core Component | polymer primary particles dispersion B1 (as solid content) | part | 90 | 80 | 90 | 90 | |
| | polymer primary particles dispersion B2 (as solid content) | part | | | 10 | | 90 |
| | colorant dispersion (as colorant component) | part | 6 | 6 | 6 | 6 | 6 |
| Amount (part) of Shell Component | polymer primary particles dispersion B1 (as solid content) | part | | | | 10 | |
| | polymer primary particles dispersion B2 (as solid content) | part | 10 | 20 | | | 10 |
| Wax Dust Emission (Dw) | dust emission from A1 wax ($Dw_{A1}$) | CPM | 26,723 | 26,723 | 26,723 | 26,723 | 26,723 |
| | dust emission from A2 wax ($Dw_{A2}$) | CPM | 155,631 | 155,631 | 155,631 | 155,631 | 155,631 |

TABLE 2-continued

| | | unit | Example 1 | Example 2 | Example 3 | Comparative Example 1 | Comparative Example 2 |
|---|---|---|---|---|---|---|---|
| Wax Concentration Cw | amount (% by mass) of A1 wax in toner for development of electrostatic images ($Cw_{A1}$) | % by mass | 8.3 | 7.4 | 8.3 | 9.2 | 0 |
| | amount (% by mass) of A2 wax in toner for development of electrostatic images ($Cw_{A2}$) | % by mass | 0.9 | 1.8 | 0.9 | 0 | 9.2 |
| Wax-Caused Dust Emission $Dw_{A11}$ | wax-caused dust emission ($Dw_{A11}$) ($Dw_{A1} \times Cw_{A1} + Dw_{A2} \times Cw_{A2}$)/100 | CPM | 3,619 | 4,779 | 3,619 | 2,459 | 14,318 |
| Dust Emission from Toner for Development | toner for development | — | D1 | D2 | D3 | D4 | D5 |
| | Dt | CPM | 118 | 444 | 112 | 22 | 5,665 |
| Fixation Test | — | — | ○○ | ○○ | ○ | x | ○○ |
| Dust Emission Rate results in 36 sheets/minute | Vd | mg/hr | 0.6 | 0.9 | 0.6 | less than 0.6 | 3.7 |
| | Evaluation | — | ○○ | ○ | ○○ | ○○ | x |

The horizontal axis in FIG. 4 shows the dust emission (Dt) from toner for development at a printing speed of 36 sheets/min in terms of A4 short side feed, and the vertical axis therein shows the dust emission rate (Vd) that is the amount of dust emitted per hour in continuous printing in an image forming device.

The found data (Dt, Vd) in Examples 1 to 3 and Comparative Example 2 shown in Table 1 are plotted with ♦ (diamond) dots, and the found data were combined in a primary linear equation according to the least squares method to give a solid line. In FIG. 4, in Comparative Example 1, the dust emission rate was lower than the detection limit, and therefore the data are not plotted. As shown by the solid line given by the ♦ (diamond) dots of FIG. 4, the primary linear equation of the solid line is $Vd=5.534^{-4}\times Dt+0.574$, and the square of the correlation coefficient thereof is 0.999, and accordingly, the dust emission rate (Vd) from the image forming device is in primary linear proportion to the dust emission (Dt) from the toner for development.

The dust amount in the image forming device using the toner for development (dust emission rate: Vd) is proportional to the varying printing speed. Consequently, the found data of the dust emission rate in Examples 1 to 3 and Comparative Example 2 are calculated in proportion to the printing speed presumed to vary, thereby estimating the dust emission rate (Vd) at each printing speed. For example, in a case where the printing speed is 120 sheets/min, the value calculated by dividing the value of 120 sheets/min by the actually measured value of 36 sheets/min is multiplied by the actually measured dust emission rate 3.7, 12.3 (120/36×3.7=12.3) is the dust emission rate (Vd) of the dust emitted from the image forming device at a printing speed of 120 sheets/min. The dust emission rate (Vd) thus estimated through proportional calculation at each printing speed is plotted as the value of the dust emission (Dt) from each toner in Examples 1 to 3 and Comparative Example 2, and the relationship between the dust emission rate (Vd) at each printing speed (sheets/min) and the dust emission (Dt) from the toner is drawn in a primary linear equation according to the least squares method, thereby giving the dotted line as illustrated.

Further in FIG. 4, a horizontal line is drawn at the dust emission rate Vd of 3.0 as a specific value. From the horizontal axis value on the intersection coordinates of the horizontal line and the dotted line and the solid line drawn from the relationship between the toner dust emission (Dt) and the dust emission rate (Vd) from the image forming device in a primary linear equation using the least squares method, the upper limit of the toner dust emission (DtL) in the case where the dust emission rate Vd is 3.0 or less was derived.

FIG. 5 shows a relationship between the printing speed (Vp) and the upper limit of toner dust emission (DtL) at the specific value (regulation value) of each dust emission rate. The horizontal axis shows the printing speed (Vp) in terms of A4 short side feed, and the vertical axis shows the upper limit of the toner dust emission (DtL).

As shown in FIG. 5, when the printing speed is higher, then the toner to be consumed per unit hour for development of electrostatic images increases more, and therefore for controlling the dust emission to be not more than the specific value (regulation value), the upper limit of the dust emission from the toner for development of electrostatic images per unit mass must also be controlled to be small. The relationship between the printing speed (Vp) and the upper limit of the toner dust emission (DtL) shown in FIG. 5 is given an inversely proportional formula according to the least squares method, then a formula to calculate the upper limit of the toner dust emission at the specific value (regulation value) of each dust emission rate can be thereby derived.

The toner for development of electrostatic images that satisfies the following formula (1) is free from a problem of hot offset and the dust emission rate (Vd) thereof can satisfy the specific value of 3.0 or less.

$$101 \leq Dt \leq 195{,}449/Vp - 1{,}040 \quad (1)$$

[In the above formula, Dt represents the dust emission (CPM) in heating the toner in a static environment; Vp represents the printing speed (sheets/min) in terms of A4 short side feed in an image forming device, and Vp is 171.2 or less.]

Examples 1 to 3 of the present invention all satisfy the above-mentioned formula (1), and the dust amount emitted per hour in continuous printing in the image forming device at a printing speed of 36 sheets/min (dust emission rate: Vd) was reduced to 0.6 or 0.9. In addition, in the fixation test, blistering caused by hot offset did not occur even at the image density of more than 1.6 (excellent (OO) or good (O)), and the hot offset resistance of the toner was improved.

In particular, it is confirmed that the toner for development of electrostatic images having a shell/core structure in Example 1, in which the shell part uses a wax having a large dust emission (Dw) of not less than 100,000 and the core part uses a wax having a small dust emission (Dn) of not more than 50,000, has a sustained and improved hot offset resistance even at an image density of more than 1.8 as verified by the result of the fixation test (excellent OO: double circle), than the toner for development of Example 3, in which a wax having a large dust emission (Dw) and a wax having a small dust emission were nearly uniformly dispersed.

On the other hand, with the toner for development of electrostatic images of Comparative Example 1 having a shell/core structure, in which a wax having a small dust emission (Dw) of not more than 50,000 was used in both the shell part and the core part, hot offset occurred. In addition, the toner for development of electrostatic images of Comparative Example 2 having a shell/core structure, in which a wax having a large dust emission (Dw) of not less than 100,000 was used in both the shell part and the core part, had a high dust emission rate (Vd) of 3.7 (mg/hr) at a printing speed of 36 sheets/min, and the dust amount emitted from the image forming device could not be reduced to lower than the specific level.

As shown in FIG. 4 and FIG. 5, for satisfying the dust emission rate (Vd) of not more than the specific value 1.8, the toner preferably satisfies the following formula (2).

$$101 \leq Dt \leq 117{,}262/Vp - 1{,}039 \quad (2)$$

[In the formula, Dt and Vp have the same meanings as Dt and Vp in the formula (1).]

As shown in FIG. 4 and FIG. 5, for satisfying the dust emission rate (Vd) of not more than the specific value 1.1, the toner preferably satisfies the following formula (3).

$$101 \leq Dt \leq 71{,}653/Vp - 1{,}039 \quad (3)$$

[In the formula, Dt and Vp have the same meanings as Dt and Vp in the formula (1).]

As shown in FIG. 4 and FIG. 5, for satisfying the dust emission rate (Vd) of not more than the specific value 0.8, the toner preferably satisfies the following formula (4).

$$101 \leq Dt \leq 52{,}104/Vp - 1{,}039 \quad (4)$$

[In the formula, Dt and Vp have the same meanings as Dt and Vp in the formula (1).]

While the present invention has been described in detail and with reference to specific embodiments thereof, it will be apparent to one skilled in the art that various changes and modifications can be made therein without departing from the spirit and scope thereof.

This application is based upon a Japanese patent application filed on Mar. 30, 2012 (Patent Application 2012-082217), and the contents thereof are incorporated herein by reference.

INDUSTRIAL APPLICABILITY

According to the present invention, there is provided a toner for development of electrostatic images which satisfies domestic and international standards and regulations and from which the dust emission during fixation can be reduced and of which the hot offset resistance can be improved even in high-speed machines that may consume a large amount of toner for development of electrostatic images per unit time and even in a case where the amount of toner to adhere to paper for development of electrostatic images thereon may increase in graphic use, and therefore, the invention is industrially useful.

REFERENCE SIGNS LIST

1 Draft
1*a* Air Intake Port for Draft
1*b* Exhaust Port for Draft
2 Heating Unit (hot plate)
2*a* Thermometer
3 Sample Cup (aluminium cup)
3*a* Nitrogen Introduction Port
4 Sample
4*a* Sample Thermometer
5 Suction Duct
6 Dust Counter
7 Exhaust Port
8 Exhaust Fan
9 Air Intake Port
10 Cone Collector

The invention claimed is:

1. A toner, comprising:

a binder resin;

a colorant; and a wax, wherein the wax that is in a state of being contained in the toner has at least one melting point falling within a range of from 55° C. to 90° C., wherein the toner comprises at least two types of waxes of a wax component X and a wax component Y, wherein the dust emission from the wax component Y is larger than the dust emission from the wax component X, wherein the toner has a region in which an abundance ratio of the wax component Y is larger than that of the wax component X, and the region exists more in the outer region of the toner than in the center region thereof, and wherein a dust emission (Dt) from the toner satisfies formula (1):

$$101 \leq Dt \leq 195{,}449/Vp - 1{,}040 \quad (1),$$

wherein:

Dt represents a dust emission per minute (CPM) when heating the toner; and

Vp represents a printing speed (sheets/min) in terms of A4 short side feed in an image forming device, and Vp is 171.2 or less.

2. The toner of claim 1, wherein the dust emission (Dt) from the toner satisfies formula (2):

$$101 \leq Dt \leq 117{,}262/Vp - 1{,}039 \quad (2)$$

wherein Vp is 102.8 or less.

3. The toner of claim 2, wherein the dust emission (Dt) from the toner satisfies formula (3):

$$101 \leq Dt \leq 71{,}653/Vp - 1{,}039 \quad (3)$$

wherein Vp is 62.8 or less.

4. The toner of claim 3, wherein the dust emission (Dt) from the toner satisfies formula (4):

$$101 \leq Dt \leq 52{,}104/Vp - 1{,}039 \quad (4)$$

wherein Vp is 45.7 or less.

5. The toner of claim 1, wherein the value of Vp is 20 or more.

6. The toner of claim 1, wherein the value of Vp is 30 or more.

7. The toner of claim 1, wherein the wax that is in a state of being contained in the toner has at least one melting point in a range of from 55° C. to lower than 70° C., and at least one melting point in a range of from 70° C. to 80° C.

8. The toner of claim 7, wherein the content of the wax component X is larger than the content of the wax component Y.

9. The toner of claim 8, wherein the proportion of the wax component Yin all the wax components is from 0.1% by mass to less than 10% by mass.

10. The toner of claim 9, wherein the dust emission from the wax component X is 50,000 CPM or less, and the dust emission from the wax component Y is 100,000 CPM or more.

11. The toner of claim 1, wherein the toner has a shell/core structure, and the wax contained in the shell of the shell/core structure comprises substantially the wax component Y alone, and the wax contained in the core of the shell/core structure comprises substantially the wax component X alone.

* * * * *